US010580356B2

(12) United States Patent
An et al.

(10) Patent No.: US 10,580,356 B2
(45) Date of Patent: Mar. 3, 2020

(54) DRIVER INTEGRATED CIRCUIT FOR EXTERNAL COMPENSATION AND DISPLAY DEVICE INCLUDING THE SAME

(71) Applicant: LG Display Co., Ltd., Seoul (KR)

(72) Inventors: Changho An, Hwaseong-si (KR); Byungil Kim, Gimpo-si (KR)

(73) Assignee: LG Display Co., Ltd., Seoul (KR)

( * ) Notice: Subject to any disclaimer, the term of this patent is extended or adjusted under 35 U.S.C. 154(b) by 177 days.

(21) Appl. No.: 15/808,570

(22) Filed: Nov. 9, 2017

(65) Prior Publication Data

US 2018/0137819 A1 May 17, 2018

(30) Foreign Application Priority Data

Nov. 11, 2016 (KR) ..... 10-2016-0150528

(51) Int. Cl.
*G09G 3/3233* (2016.01)

(52) U.S. Cl.
CPC ... *G09G 3/3233* (2013.01); *G09G 2300/0426* (2013.01); *G09G 2300/0842* (2013.01); *G09G 2310/027* (2013.01); *G09G 2310/0251* (2013.01); *G09G 2310/0291* (2013.01); *G09G 2310/0297* (2013.01); *G09G 2310/08* (2013.01); *G09G 2320/0233* (2013.01); *G09G 2320/0285* (2013.01); *G09G 2320/0295* (2013.01); *G09G 2320/0693* (2013.01)

(58) Field of Classification Search
CPC ..... G09G 3/3233
USPC ..... 345/77, 78, 208–214
See application file for complete search history.

(56) References Cited

U.S. PATENT DOCUMENTS 7,128,270 B2 * 10/2006 Silverbrook ..... G06F 3/03545 235/472.01
8,625,012 B2 * 1/2014 Yuan ..... H04N 5/35527 250/208.1
2008/0136338 A1 * 6/2008 Troccoli ..... G09G 3/3233 315/169.3
2010/0026639 A1 * 2/2010 Lee ..... G06F 3/0412 345/173
2010/0194956 A1 * 8/2010 Yuan ..... H04N 5/35527 348/308
2012/0212468 A1 * 8/2012 Govil ..... B81C 99/003 345/208
2014/0152642 A1 * 6/2014 Kim ..... G09G 3/3233 345/212
2015/0009204 A1 * 1/2015 Chaji ..... G09G 3/3233 345/214

(Continued)

*Primary Examiner* — Prabodh M Dharia
(74) *Attorney, Agent, or Firm* — Polsinelli PC

(57) ABSTRACT

A driver integrated circuit for external compensation and a display device including the same are disclosed. The driver integrated circuit includes a sensing unit including a plurality of sensing switches, that is connected to a plurality of pixels through a sensing channel and operates differently depending on a current sensing mode and a voltage sensing mode, the sensing unit configured to sense electrical characteristics of the pixels input from the sensing channel, a sample and hold unit configured to sample analog sensing data corresponding to the electrical characteristics of the pixels, and an analog-to-digital converter (ADC) configured to convert the analog sensing data sampled by the sample and hold unit into digital sensing data.

22 Claims, 20 Drawing Sheets

(56) References Cited

U.S. PATENT DOCUMENTS

| | | | | |
|---|---|---|---|---|
| 2015/0187267 | A1* | 7/2015 | Park | G09G 3/3233 345/77 |
| 2015/0187268 | A1* | 7/2015 | Tani | G09G 3/3233 345/77 |
| 2015/0379909 | A1* | 12/2015 | Yu | G09G 3/006 345/690 |
| 2016/0078805 | A1* | 3/2016 | Woo | G09G 3/3225 345/78 |
| 2017/0004764 | A1* | 1/2017 | Kim | G09G 3/3225 |
| 2018/0005579 | A1* | 1/2018 | Brahma | G09G 3/3258 |
| 2018/0166515 | A1* | 6/2018 | An | G09G 3/3291 |
| 2019/0166321 | A1* | 5/2019 | Ladd | H04N 5/37455 |
| 2019/0170859 | A1* | 6/2019 | Bailey | G01S 7/481 |

* cited by examiner

| | S1 | S2 | S3 | S4 |
|---|---|---|---|---|
| Current Integrator Operation Mode | OFF | ON | ON | OFF |
| First Voltage Follower Operation Mode | OFF | ON | OFF | ON |

| | S1 | S2 | S3 | S4 | S5 |
|---|---|---|---|---|---|
| Second Voltage Follower Operation Mode | ON | OFF | OFF | ON | OFF |
| Bypass Operation Mode | OFF | OFF | OFF | OFF | ON |

FIG. 20

| | T1 | T2 | T3 | T4 |
|---|---|---|---|---|
| So1 | ON | OFF | OFF | OFF |
| Se1 | ON | OFF | OFF | OFF |
| So2 | OFF | ON | OFF | OFF |
| Se2 | OFF | ON | OFF | OFF |
| So3 | OFF | OFF | ON | OFF |
| Se3 | OFF | OFF | ON | OFF |
| So4 | OFF | OFF | OFF | ON |
| Se4 | OFF | OFF | OFF | ON |

$$|V2 - V1| = (\text{CM noise} + \text{Sensing Signal}) - \text{CM noise}$$
$$= \text{Sensing Signal}$$

DRIVER INTEGRATED CIRCUIT FOR EXTERNAL COMPENSATION AND DISPLAY DEVICE INCLUDING THE SAME

CROSS-REFERENCE TO RELATED APPLICATION

This application claims the benefit of Korea Patent Application No. 10-2016-0150528 filed on Nov. 11, 2016, which is incorporated herein by reference for all purposes as if fully set forth herein.

BACKGROUND

Field of the Disclosure

The present disclosure relates to a display device, and more particularly, to a driver integrated circuit for external compensation and a display device including the same.

Description of the Background

Various types of flat panel displays have been developed and sold. Among the various types of flat panel displays, an electroluminescent display can be classified into an inorganic electroluminescent display and an organic electroluminescent display depending on a material of an emission layer. In particular, an active matrix organic light emitting diode (OLED) display includes a plurality of OLEDs capable of emitting light by themselves and has many advantages, such as fast response time, high emission efficiency, high luminance, wide viewing angle, and the like.

An OLED serving as a self-emitting element includes an anode electrode, a cathode electrode, and an organic compound layer between the anode electrode and the cathode electrode. The organic compound layer includes a hole injection layer HIL, a hole transport layer HTL, an emission layer EML, an electron transport layer ETL, and an electron injection layer EIL. When a power voltage is applied to the anode electrode and the cathode electrode, holes passing through the hole transport layer HTL and electrons passing through the electron transport layer ETL move to the emission layer EML and form excitons. As a result, the emission layer EML generates visible light.

An OLED display includes a plurality of pixels, each including an OLED and a thin film transistor (TFT), in a matrix and adjusts a luminance of an image implemented on the pixels based on a grayscale of image data. The driving TFT controls a driving current flowing in the OLED depending on a voltage (hereinafter, referred to as "a gate-to-source voltage") between a gate electrode and a source electrode of the driving TFT. An amount of light emitted by the OLED is determined depending on the driving current of the OLED, and the luminance of the image is determined depending on the amount of light emitted by the OLED.

In general, when a driving TFT operates in a saturation region, a driving current Ids flowing between a drain electrode and a source electrode of the driving TFT is expressed by the following Equation 1.

$$Ids=\tfrac{1}{2}*(\mu*C*W/L)*(Vgs-Vth)^2 \quad \text{[Equation 1]}$$

In Equation 1, μ is an electron mobility, C is a capacitance of a gate insulating layer, W is a channel width of the driving TFT, and L is a channel length of the driving TFT. In addition, Vgs is a voltage between a gate electrode and a source electrode of the driving TFT, and Vth is a threshold voltage (or a critical voltage) of the driving TFT. A gate-to-source voltage Vgs of the driving TFT may be a voltage differential between a data voltage and a reference voltage in accordance with a pixel structure. The data voltage is an analog voltage corresponding to a grayscale of image data, and the reference voltage is a fixed voltage. Therefore, the gate-to-source voltage Vgs of the driving TFT is programmed or set depending on the data voltage. Then, the driving current Ids is determined depending on the programmed gate-to-source voltage Vgs.

Electrical characteristics of the pixel, such as the threshold voltage Vth and the electron mobility μ of the driving TFT and a threshold voltage of the OLED, may be factors determining an amount of driving current Ids of the driving TFT. Therefore, all the pixels are supposed to have the same electrical characteristics. However, a variation in the electrical characteristics between the pixels may be generated by various causes such as process characteristics and time-varying characteristics. The variation in the electrical characteristics between the pixels may lead to a luminance variation, and it is difficult to implement a desired image.

In order to compensate for the luminance variation between the pixels, there is known an external compensation technique for sensing electrical characteristics of the pixels and correcting digital data of an input image based on a sensing result. In order to compensate for the luminance variation, a current change by Δy has to be ensured when the data voltage applied to the pixel is changed by "Δx". Thus, the external compensation technique is to implement the same brightness by calculating "Δx" for each pixel and applying the same driving current to the OLED. Namely, the external compensation technique is to adjust gray levels so that the pixels have the same brightness.

In order to implement the external compensation technique, a display panel including pixels, a sensor that is connected to the pixels of the display panel through sensing lines and senses electrical characteristics of the pixels, a voltage generator for supplying voltages necessary for the pixels and the sensor, and an analog-to-digital converter (ADC) for converting analog sensing data input from the sensor into digital sensing data are required. A plurality of sensors, a plurality of voltage generators, and a plurality of ADCs may be embedded in a driver integrated circuit (IC).

The digital sensing data output from the ADCs may be distorted by various causes, for example, a common noise present in the sensing lines, an offset variation between the voltage generators, an offset variation between the sensors, and an offset variation between the ADCs. If sensing data is distorted, a luminance deviation resulting from a difference in electrical characteristics between the pixels cannot be compensated properly.

SUMMARY

The present disclosure provides a driver integrated circuit for external compensation and a display device including the same capable of minimizing a distortion of sensing data by increasing a sensing performance of electrical characteristics of pixels.

In one aspect, there is provided a driver integrated circuit for external compensation including a sensing unit including a plurality of sensing switches, that is connected to a plurality of pixels through a sensing channel and operates differently depending on a current sensing mode and a voltage sensing mode, the sensing unit configured to sense electrical characteristics of the pixels input from the sensing channel; a sample and hold unit configured to sample analog sensing data corresponding to the electrical characteristics of the pixels; and an analog-to-digital converter (ADC) configured to convert the analog sensing data sampled by the sample and hold unit into digital sensing data.

BRIEF DESCRIPTION

The accompanying drawings, which are included to provide a further understanding of the disclosure and are incorporated in and constitute a part of this specification, illustrate aspects of the disclosure and together with the description serve to explain the principles of the disclosure.

In the drawings:

FIG. 1 is a block diagram of an electroluminescent display for external compensation according to an aspect of the disclosure;

FIG. 2 schematically illustrates a connection configuration between a pixel and a driver integrated circuit (IC) for external compensation according to an aspect of the disclosure;

FIG. 20 illustrates a switching timing of channel switches of a driver IC for external compensation of FIGS. 18 and 19 to perform correlated double sampling.

DETAILED DESCRIPTION

Figure 1:
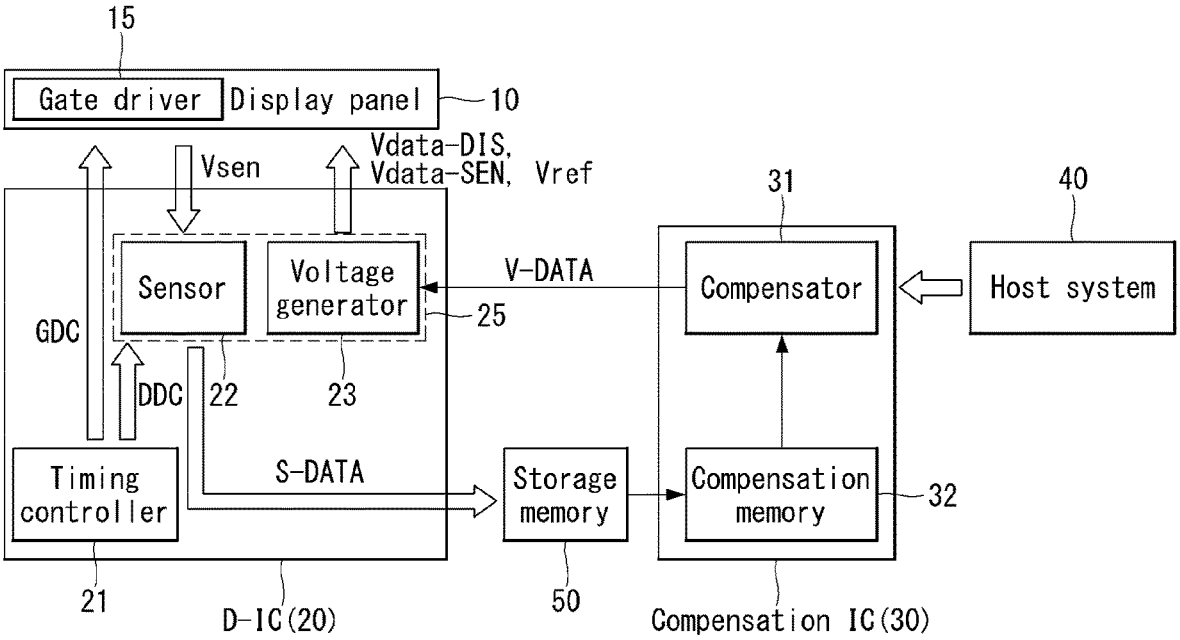

Reference will now be made in detail to aspects of the present disclosure, examples of which are illustrated in the accompanying drawings. However, the present disclosure is not limited to aspects disclosed below, and may be implemented in various forms. These aspects are provided so that the present disclosure will be exhaustively and completely described, and will fully convey the scope of the present disclosure to those skilled in the art to which the present disclosure pertains. The present disclosure is only defined by the scope of the claims.

Shapes, sizes, ratios, angles, number, and the like illustrated in the drawings for describing aspects of the present disclosure are merely exemplary, and the present disclosure is not limited thereto. Like reference numerals designate like elements throughout. In the following description, when a detailed description of well-known functions or configurations related to this document is determined to unnecessarily cloud a gist of the disclosure, the detailed description thereof will be omitted.

In the present disclosure, when the terms "include", "have", "comprised of", etc. are used, other components may be added unless "~only" is used. A singular expression can include a plural expression as long as it does not have an apparently different meaning in context.

In the explanation of components, even if there is no separate description, it is interpreted as including an error range.

In the description of position relationship, when a structure is described as being positioned "on or above", "under or below", "next to" another structure, this description should be construed as including a case in which the structures contact each other as well as a case in which a third structure is disposed therebetween.

The terms "first", "second", etc. may be used to describe various components, but the components are not limited by such terms. The terms are used only for the purpose of distinguishing one component from other components. For example, a first component may be designated as a second component without departing from the scope of the present disclosure.

The features of various aspects of the present disclosure can be partially combined or entirely combined with each other, and can be technically interlocking-driven in various ways. The aspects can be independently implemented, or can be implemented in conjunction with each other.

Various aspects of the present disclosure will be described in detail below with reference to the accompanying drawings. In the following aspects, an electroluminescent display will be described focusing on an organic light emitting diode (OLED) display including an organic light emitting material. However, it should be noted that aspects of the present disclosure are not limited to the OLED display, and may be applied to an inorganic light emitting display including an inorganic light emitting material. Further, it should be noted that aspects of the present disclosure may be applied not only to an electroluminescent display but also to various display devices such as a flexible display device and a wearable display device.

Figure 2:
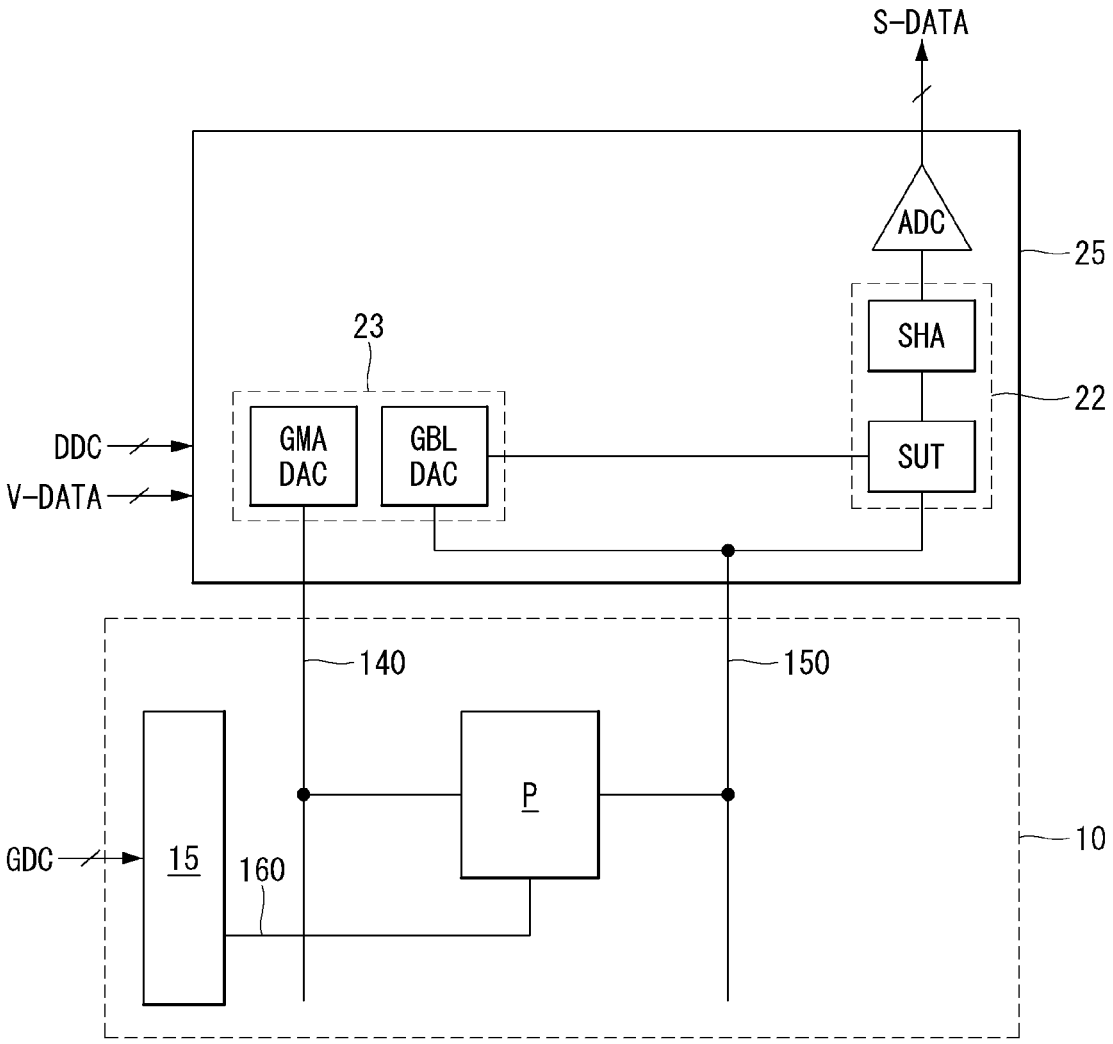
Figure 3:
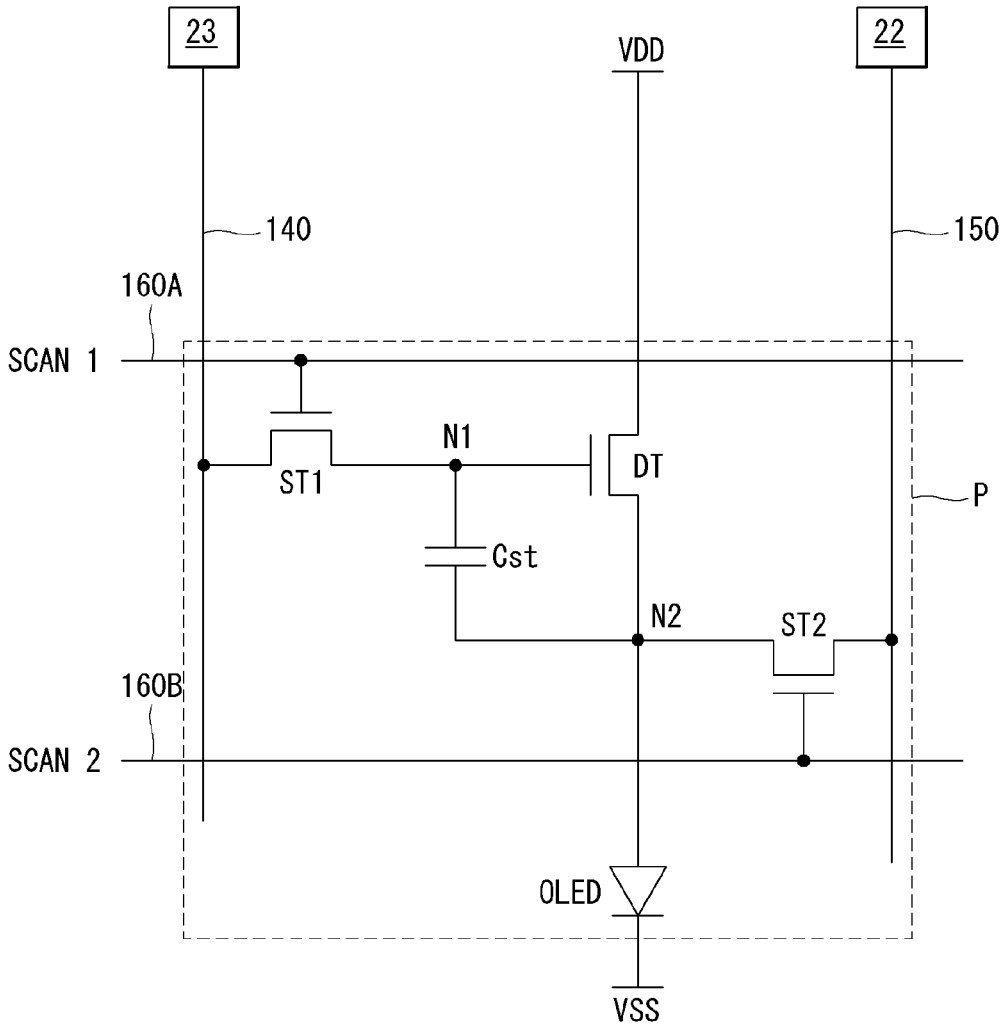
FIG. 3 is an equivalent circuit diagram of a pixel according to an aspect of the disclosure.
Figure 4:
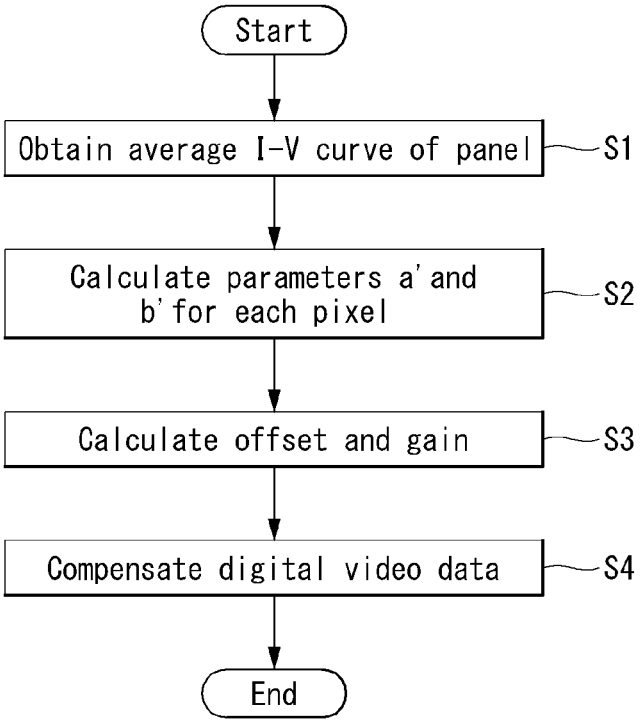
FIG. 4 is a flow chart illustrating an external compensation method according to an aspect of the disclosure.
Figure 5A:
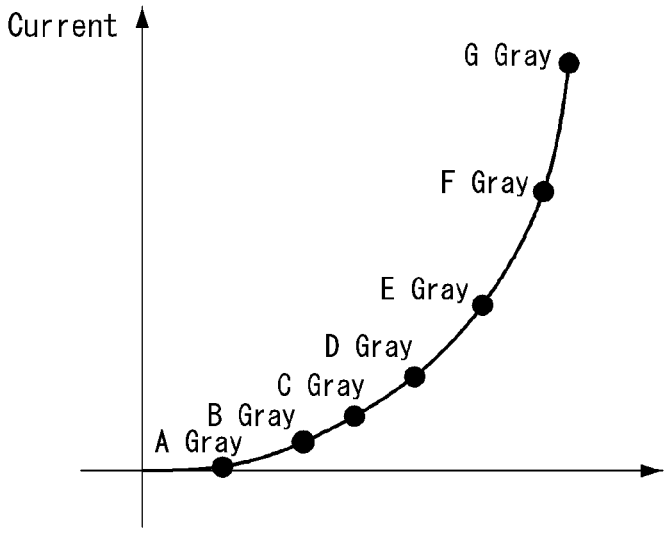
FIG. 5A illustrates that a reference curve equation is obtained in an external compensation method of FIG. 4.
Figure 5B:
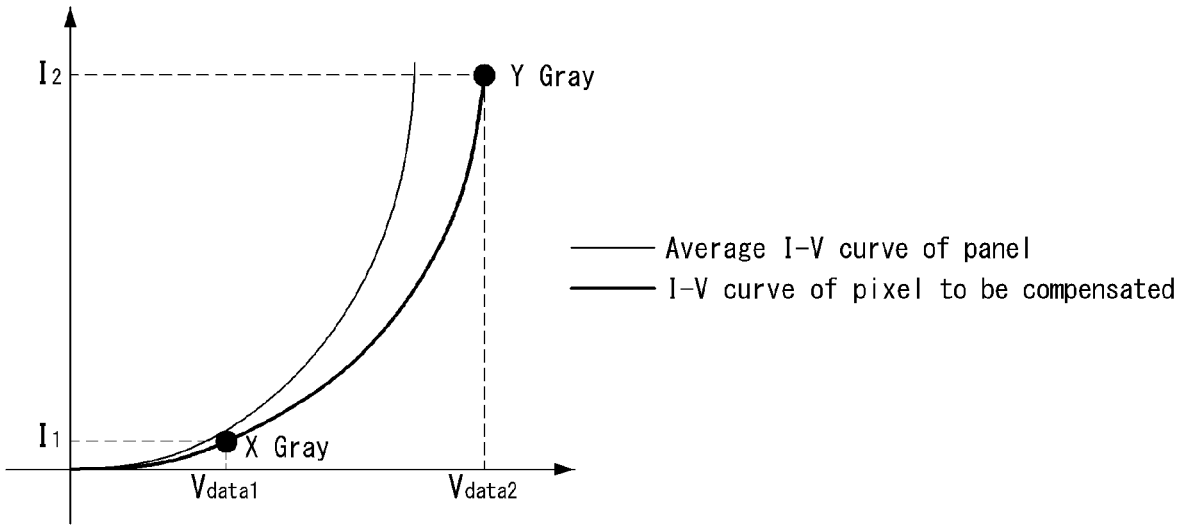
FIG. 5B illustrates an average I-V curve of a display panel and an I-V curve of a pixel to be compensated in an external compensation method of FIG. 4.
Figure 5C:
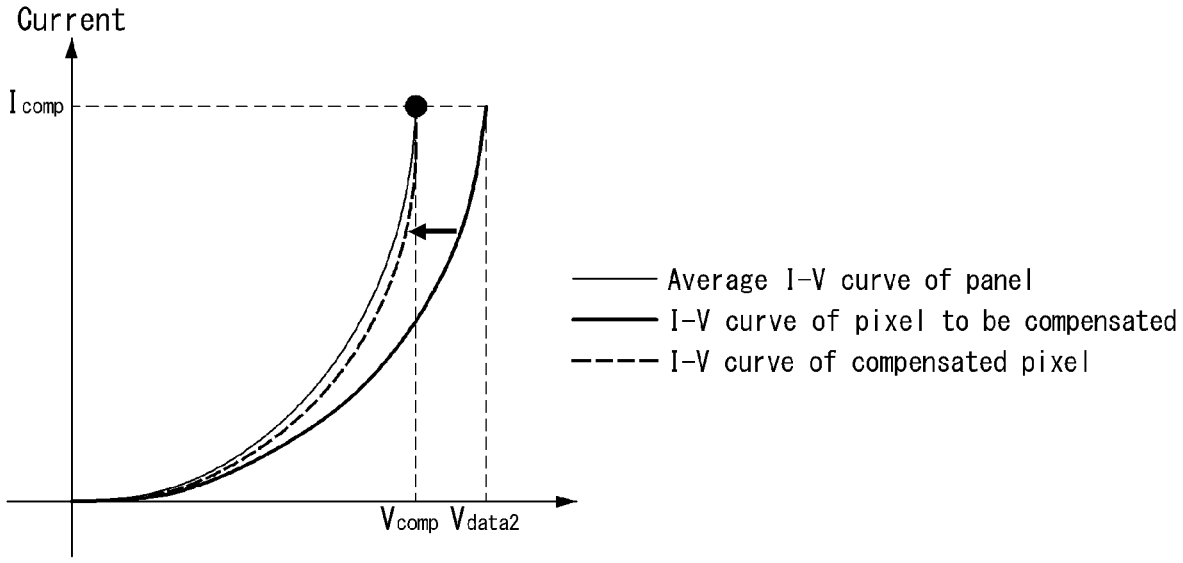
FIG. 5C illustrates an average I-V curve of a display panel, an I-V curve of a pixel to be compensated, and an I-V curve of a compensated pixel in an external compensation method of FIG. 4.

FIG. 1 is a block diagram of an electroluminescent display for external compensation according to an aspect of the disclosure. FIG. 2 schematically illustrates a connection configuration between a pixel and a driver integrated circuit (IC) for external compensation according to an aspect of the disclosure. FIG. 3 is an equivalent circuit diagram of a pixel according to an aspect of the disclosure. FIG. 4 is a flow chart illustrating an external compensation method according to an aspect of the disclosure. FIG. 5A illustrates that a reference curve equation is obtained in the external compensation method of FIG. 4. FIG. 5B illustrates an average I-V curve of a display panel and an I-V curve of a pixel to be compensated in the external compensation method of FIG. 4. FIG. 5C illustrates an average I-V curve of a display panel, an I-V curve of a pixel to be compensated, and an I-V curve of a compensated pixel in the external compensation method of FIG. 4.

Referring to FIGS. 1 to 3, an electroluminescent display according to an aspect of the disclosure may include a display panel 10, a driver IC (or referred to as "D-IC") 20, a compensation IC 30, a host system 40, and a storage memory 50. A driving circuit for external compensation according to the aspect of the disclosure includes a gate driver 15 included in the display panel 10, the driver IC 20, the compensation IC 30, and the storage memory 50.

The display panel 10 includes a plurality of pixels P and a plurality of signal lines. The signal lines may include data lines 140 for supplying an analog data voltage to the pixels P and gate lines 160 for supplying a gate signal to the pixels P. In aspects disclosed herein, the gate signal may include a plurality of gate signals including a first gate signal SCAN1 and a second gate signal SCAN2. In this instance, each gate line 160 may include a first gate line 160A for supplying the first gate signal SCAN1 and a second gate line 160B for supplying the second gate signal SCAN2. However, the gate signal may include one gate signal depending on a circuit configuration of the pixel P. In this instance, each gate line 160 may include a single gate line. However, aspects of the disclosure are not limited to exemplary configurations of the gate signal and the gate line 160.

The signal lines may further include sensing lines 150 that are used to supply a reference voltage Vref to the pixels P and to sense electrical characteristics of the pixels P. However, the electrical characteristics of the pixels P may be sensed through the data lines 140 as well as the sensing lines 150. In the following description, it is described that the electrical characteristics of the pixels P are sensed through the sensing lines 150 for convenience, but aspects are not limited thereto. Aspects may be applied to all cases in which the electrical characteristics of the pixels P are sensed through the sensing lines 150 or the data lines 140.

The pixels P of the display panel 10 are disposed in a matrix to form a pixel array. Each pixel P may be connected to one of the data lines 140, one of the sensing lines 150, and at least one of the gate lines 160. Each pixel P receives a high potential pixel power and a low potential pixel power from a power generator. To this end, the power generator may supply the high potential pixel power to the pixel P through a high potential pixel power line or a pad and may supply the low potential pixel power to the pixel P through a low potential pixel power line or a pad.

The gate driver 15 may generate a display gate signal necessary for a display drive and a sensing gate signal necessary for a sensing drive. Each of the display gate signal and the sensing gate signal may include a first gate signal SCAN1 and a second gate signal SCAN2.

In the display drive, the gate driver 15 may generate a first display gate signal SCAN1 to supply the first display gate signal SCAN1 to the first gate line 160A, and may generate a second display gate signal SCAN2 to supply the second display gate signal SCAN2 to the second gate line 160B. The first display gate signal SCAN1 is a signal synchronized with an application timing of a display data voltage Vdata-DIS, and the second display gate signal SCAN2 is a signal synchronized with an application timing of the reference voltage Vref.

In the sensing drive, the gate driver 15 may generate a first sensing gate signal SCAN1 to supply the first sensing gate signal SCAN1 to the first gate line 160A, and may generate a second sensing gate signal SCAN2 to supply the second sensing gate signal SCAN2 to the second gate line 160B. The first sensing gate signal SCAN1 is a signal synchronized with an application timing of a sensing data voltage Vdata-SEN, and the second sensing gate signal SCAN2 is a signal synchronized with an application timing of the reference voltage Vref.

The gate driver 15 may be directly formed on a lower substrate of the display panel 10 in a gate driver-in panel (GIP) manner. The gate driver 15 may be formed in a non-display area (i.e., a bezel area) outside the pixel array of the display panel 10 through the same TFT forming process as the pixel array.

The driver IC 20 includes a timing controller 21, a data driver 25, and an analog-to-digital converter (ADC). The data driver 25 may include a sensor 22 and a voltage generator 23, but is not limited thereto.

The timing controller 21 may generate a gate timing control signal GDC for controlling operation timing of the gate driver 15 and a data timing control signal DDC for controlling operation timing of the data driver 25 based on timing signals, for example, a vertical sync signal Vsync, a horizontal sync signal Hsync, a dot clock signal DCLK, and a data enable signal DE received from the host system 40.

The data timing control signal DDC may include a source start pulse, a source sampling clock, and a source output enable signal, and the like, but is not limited thereto. The source start pulse controls start timing of data sampling of the data driver 25. The source sampling clock is a clock signal that controls sampling timing of data based on a rising edge or a falling edge. The source output enable signal controls output timing of the data driver 25.

The gate timing control signal GDC may include a gate start pulse, a gate shift clock, and the like, but is not limited thereto. The gate start pulse is applied to a stage of the gate driver 15 for generating a first output and activates an operation of the stage. The gate shift clock is a clock signal that is commonly input to stages and shifts the gate start pulse.

The timing controller 21 may control the sensing drive and the display drive in accordance with to a predetermined control sequence. The sensing drive is an operation of sensing electrical characteristics of the pixel P and updating a compensation value for compensating for changes in the electrical characteristics of the pixel P based on a sensing result. The display drive is an operation of modulating input digital image data based on the compensation value obtained in the sensing drive, converting the modulated digital image data into an analog data voltage, applying the analog data voltage to the pixel, and displaying an input image.

The timing controller 21 may differently generate timing control signals for the display drive and timing control signals for the sensing drive. However, aspects are not limited thereto. The sensing drive may be performed in a vertical blanking interval during the display drive, in a power-on sequence interval before the beginning of the display drive, or in a power-off sequence interval after the end of the display drive under the control of the timing controller 21. However, aspects are not limited thereto. For example, the sensing drive may be performed in a vertical active period during the display drive.

The vertical blanking interval is time, for which input digital image data is not written, and is arranged between vertical active periods in which input digital image data of one frame is written. The power-on sequence interval is a transient time between the turn-on of driving power and the beginning of image display. The power-off sequence interval is a transient time between the end of image display and the turn-off of driving power.

The timing controller 21 may control all of operations for the sensing drive in accordance with a predetermined sensing process. Namely, the sensing drive may be performed in a state (for example, a standby mode, a sleep mode, a low power mode, etc.) where only a screen of the display device is turned off while the system power is being applied. However, aspects are not limited thereto.

The timing controller 21 may selectively control an operation of the sensor 22 in a current sensing mode or a voltage sensing mode depending on a register setting value, which is previously determined by a user in the sensing drive.

The timing controller 21 may additionally control an operation of the sensor 22 in accordance with a calibration process. The calibration process may be performed to compensate for an output variation of the ADC, an output variation of the sensor 22, etc. The calibration process may be performed during a predetermined time of the sensing drive. Sensing data can be minimized or prevented from being distorted by the output variation of the ADC, the output variation of the sensor 22, etc. by reflecting ADC variation compensation (AVC) data obtained in the calibration process in the compensation value for compensating for changes in the electrical characteristics of the pixel P. Because changes (for example, offset change) in characteristics of the ADC and the sensor 22 proceed relatively slower than the change in the electrical characteristics of the pixel P, the calibration process may be performed once each time the sensing drive is performed a plurality of times. However, aspects are not limited thereto. For example, the calibration process may be performed each time the sensing drive is performed.

The voltage generator 23 includes a digital-to-analog converter (DAC) converting a digital signal into an analog signal. The DAC includes a GMA DAC generating the display data voltage Vdata-DIS or the sensing data voltage Vdata-SEN and a GBL DAC generating the reference voltage Vref.

In the display drive, the voltage generator 23 converts digital image data V-DATA into an analog gamma voltage using the GMA DAC and supplies the data lines 140 with a conversion result as the display data voltage Vdata-DIS. Further, the voltage generator 23 generates the reference voltage Vref using the GBL DAC and supplies the reference voltage Vref to the sensing lines 150. In the display drive, the display data voltage Vdata-DIS supplied to the data lines 140 is applied to the pixels P in synchronization with turn-on timing of the first gate signal SCAN1, and the reference voltage Vref supplied to the sensing lines 150 is applied to the pixels P in synchronization with turn-on timing of the second gate signal SCAN2. A gate-to-source voltage of a driving thin film transistor (TFT) included in the pixel P is programmed by the display data voltage Vdata-DIS and the reference voltage Vref, and a driving current flowing in the driving TFT is determined depending on the gate-to-source voltage of the driving TFT.

In the sensing drive, the voltage generator 23 generates the sensing data voltage Vdata-SEN, that is previously determined using the GMA DAC, and supplies the sensing data voltage Vdata-SEN to the data lines 140. Further, the voltage generator 23 generates the reference voltage Vref using the GBL DAC and supplies the reference voltage Vref to the sensing lines 150 and the sensor 22. In the sensing drive, the sensing data voltage Vdata-SEN supplied to the data lines 140 is applied to the pixels P in synchronization with turn-on timing of the first gate signal SCAN1, and the reference voltage Vref supplied to the sensing lines 150 is applied to the pixels P in synchronization with turn-on timing of the second gate signal SCAN2. The gate-to-source voltage of the driving TFT included in the pixel P is programmed by the sensing data voltage Vdata-SEN and the reference voltage Vref, and a driving current flowing in the driving TFT is determined depending on the gate-to-source voltage of the driving TFT.

In the sensing drive, the sensor 22 may sense the electrical characteristics of the pixels P, for example, electrical characteristics of the driving TFTs and/or OLEDs included in the pixels P through the sensing lines 150.

In the sensing drive, the sensor 22 may operate in a current sensing mode or a voltage sensing mode under the control of the timing controller 21. In aspects disclosed herein, the current sensing mode is a mode of directly sensing the driving current flowing in the driving TFT of the pixel P. The voltage sensing mode is a mode of sensing a voltage charged to a sensing channel by the driving current flowing in the driving TFT of the pixel P.

The sensor 22 includes a sensing unit SUT and a sample and hold unit SHA. The sensing unit SUT may include a plurality of sensing switches that is connected to the plurality of pixels P through a sensing channel and operates differently depending on the current sensing mode and the voltage sensing mode under the control of the timing controller 21.

In the current sensing mode, the sensing unit SUT may operate in a current integrator operation mode in which a current can be sensed in accordance with a switching operation of the plurality of sensing switches. The current integrator operation mode is used to sense the electrical characteristics of the pixels P. In the current sensing mode, the sensing unit SUT may operate in a first voltage follower operation mode in which a voltage can be sensed in accordance with a switching operation of the plurality of sensing switches. The first voltage follower operation mode is used to obtain the AVC data in the calibration process. When the sensing unit SUT operates as a voltage follower, the accuracy of sensing data can be further improved because an offset variation of the sensing unit SUT is reflected in the AVC data. Because the first voltage follower operation mode corresponds to the calibration process for obtaining the AVC data, the first voltage follower operation mode may be performed each time the sensing drive is performed, or may be performed once each time the sensing drive is performed a plurality of times.

In the voltage sensing mode, the sensing unit SUT may operate in a second voltage follower operation mode or a bypass operation mode depending on a switching operation of the plurality of sensing switches. In the second voltage follower operation mode, the sensing channel and the sample and hold unit SHA may be connected through a voltage buffer (or a voltage follower). In the bypass operation mode, the sensing channel and the sample and hold unit SHA may bypass the sensing unit SUT and may be directly connected.

In the voltage sensing mode, the sample and hold unit SHA may sense a voltage charged to the sensing channel by the driving current flowing in the driving TFT of the pixel P and may obtain the AVC data through the calibration process. The calibration process for obtaining the AVC data may be performed each time the sensing drive is performed, or may be performed once each time the sensing drive is performed a plurality of times.

The ADC may sequentially process a plurality of analog sensing data. One ADC or a plurality of ADCs may be mounted in the driver IC 20. A sampling rate of the ADC and the accuracy of the sensing are in a trade-off relationship. Because an amount of sensing data to be processed by each ADC decreases as the number of ADCs mounted in the driver IC 20 increases, the sampling rate of the ADC can be reduced and the accuracy of the sensing can increase. However, when the number of ADCs increases, an area occupied by the ADC in the driver IC 20 may increase. This problem may be solved by the ADC and the voltage generator 23 sharing a circuit element (for example, GAC) with each other.

The ADC may be implemented as a flash ADC, an ADC using a tracking method, a successive approximation register ADC, and the like. The ADC converts analog sensing data into digital sensing data S-DATA and supplies the digital sensing data S-DATA to the storage memory 50 in the sensing drive. Then, the ADC supplies the AVC data obtained in the calibration process to the storage memory 50.

The storage memory 50 stores the digital sensing data S-DATA and the AVC data, which are input from the sensor 22, in the sensing drive. The storage memory 50 may be implemented as a flash memory, but is not limited thereto.

The compensation IC 30 calculates an offset and a gain for each pixel based on the digital sensing data S-DATA and the AVC data, which are read from the storage memory 50, for the purpose of the display drive. The compensation IC 30 modulates (or corrects) digital image data to be input to the pixels P in accordance with the calculated offset and gain and supplies the modulated digital image data V-DATA to the driver IC 20. To this end, the compensation IC 30 may include a compensator 31 and a compensation memory 32.

The compensation memory 32 transmits the digital sensing data S-DATA and the AVC data read from the storage memory 50 to the compensator 31. The compensation memory 32 may be a random access memory (RAM), for example, a double data rate synchronous dynamic RAM (DDR SDRAM), but is not limited thereto.

As shown in FIGS. 4 to 5C, the compensator 31 may include a compensation algorithm that performs a compensation operation so that an current (I)-voltage (V) curve of a pixel to be compensated coincides with an average I-V curve that can be obtained through a plurality of sensing operations.

More specifically, as shown in FIGS. 4 and 5A, the compensator 31 performs the sensing of a plurality of gray levels (for example, a total of seven gray levels A to G) and then obtains the following Equation 2 corresponding to the average I-V curve through a least square method in step S1.

$$I=a(V_{data}-b)^c \quad \text{[Equation 2]}$$

where "a" is an electron mobility of the driving TFT, "b" is a threshold voltage of the driving TFT, and "c" is a physical property value of the driving TFT.

As shown in FIGS. 4 and 5B, the compensator 31 calculates parameter values a' and b' of a corresponding pixel P based on current values I1 and I2 and gray values (gray levels X and Y) (i.e., data voltage values Vdata1 and Vdata2) measured at two points in step S2.

$$I_1=a'(V_{data1}-b)^c$$

$$I_2=a'(V_{data2}-b)^c \quad \text{[Equation 3]}$$

The compensator 31 may calculate the parameter values a' and b' of the corresponding pixel P using a quadratic equation in the above Equation 3.

As shown in FIGS. 4 and 5C, the compensator 31 may calculate an offset and a gain for causing an I-V curve of the corresponding pixel P to coincide with the average I-V curve in step S3. The offset and the gain of the compensated pixel are expressed by Equation 4.

$$Vcomp = \boxed{\text{Gain}\ \left(\frac{a}{a'}\right)^{\frac{1}{c}}} \times V_{data} + \boxed{\text{Offset}\ \left(b' - b\left(\frac{a}{a'}\right)^{\frac{1}{c}}\right)} \quad \text{[Equation 4]}$$

where "Vcomp" is a compensation voltage.

The compensator 31 corrects digital image data to be input to the corresponding pixel P so that the digital image data corresponds to the compensation voltage Vcomp, in step S4.

The host system 40 may supply digital image data to be input to the pixels P of the display panel 10 to the compensation IC 30. The host system 40 may further supply user input information, for example, digital brightness information to the compensation IC 30. The host system 40 may be implemented as an application processor.

The voltage generator 23 of the data driver 25 may be connected to the pixel P through the data line 140, and the sensor 22 of the data driver 25 may be connected to the pixel P through the sensing line 150. In this instance, an exemplary configuration of the pixel P is shown in FIG. 3. However, the pixel configuration of FIG. 3 is merely an example, and aspects are not limited thereto.

The pixel P of FIG. 3 may be used as a pixel for the display drive and a pixel for the sensing drive. Thus, the first gate signal SCAN1 may be a first display gate signal SCAN1 or a first sensing gate signal SCAN1, and the second gate signal SCAN2 may be a second display gate signal SCAN2 or a second sensing gate signal SCAN2. Further, the voltage generator 23 may supply the display data voltage Vdata-DIS or the sensing data voltage Vdata-SEN to the data lines 140. Although not shown, the voltage generator 23 may supply the reference voltage Vref to the sensing lines 150. The sensor 22 may sense electrical characteristics of the pixel P through the sensing line 150.

The pixel P may include an OLED, a driving TFT DT, a storage capacitor Cst, a first switching TFT ST1, and a second switching TFT ST2.

The OLED is a light emitting element that emits light in accordance with a driving current input from the driving TFT DT. The OLED includes an anode electrode, a cathode electrode, and an organic compound layer between the anode electrode and the cathode electrode. The anode electrode is connected to a first node N1 that is a gate electrode of the driving TFT DT. The cathode electrode is connected to an input terminal of a low potential driving voltage VSS. A gray level of an image displayed on a corresponding pixel is determined depending on an amount of light emitted by the OLED.

The driving TFT DT is a driving element controlling a driving current input to the OLED depending on a gate-to-source voltage Vgs of the driving TFT DT. The driving TFT DT includes a gate electrode connected to the first node N1, a drain electrode connected to an input terminal of a high potential driving voltage VDD, and a source electrode connected to a second node N2.

The storage capacitor Cst is connected between the first node N1 and the second node N2. The storage capacitor Cst holds the gate-to-source voltage Vgs of the driving TFT DT for a predetermined time.

The first switching TFT ST1 applies the display data voltage or the sensing data voltage on the data line 140 to the first node N1 in response to the first gate signal SCAN1. The first switching TFT ST1 includes a gate electrode connected to the first gate line 160A, a drain electrode connected to the data line 140, and a source electrode connected to the first node N1.

The second switching TFT ST2 switches on and off a current flow between the second node N2 and the sensing line 150 in response to the second gate signal SCAN2. The second switching TFT ST2 includes a gate electrode connected to the second gate line 160B, a drain electrode connected to the sensing line 150, and a source electrode connected to the second node N2. When the second switching TFT ST2 is turned on, the second node N2 and the sensor 22 are electrically connected.

Figure 6:
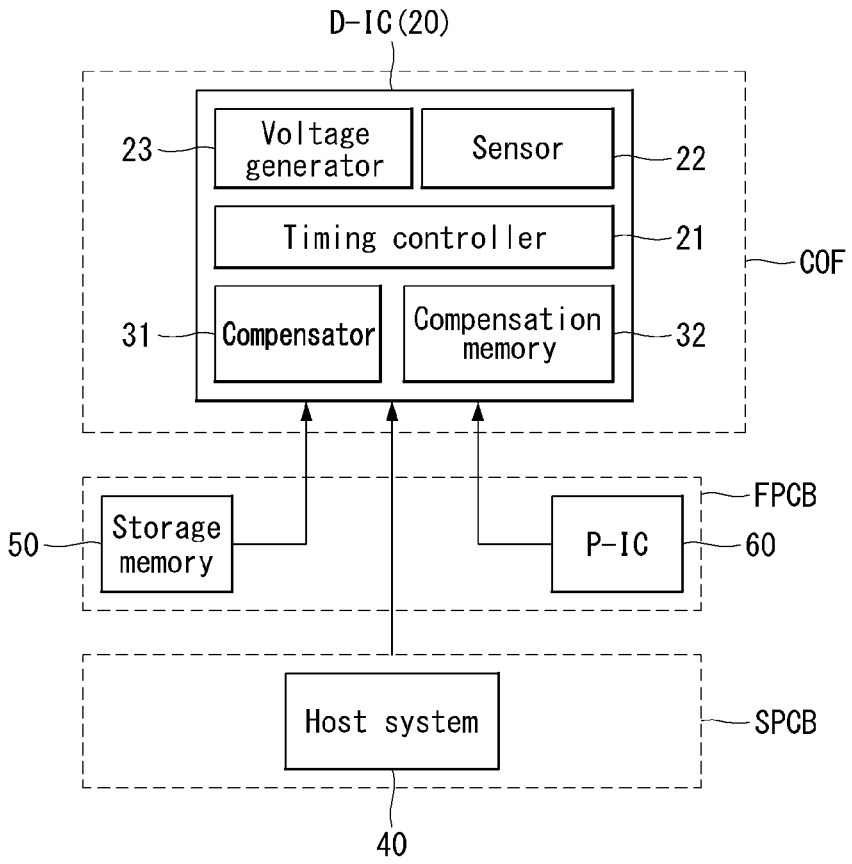
FIGS. 6 to 8 illustrate various examples of an external compensation module.
Figure 7:
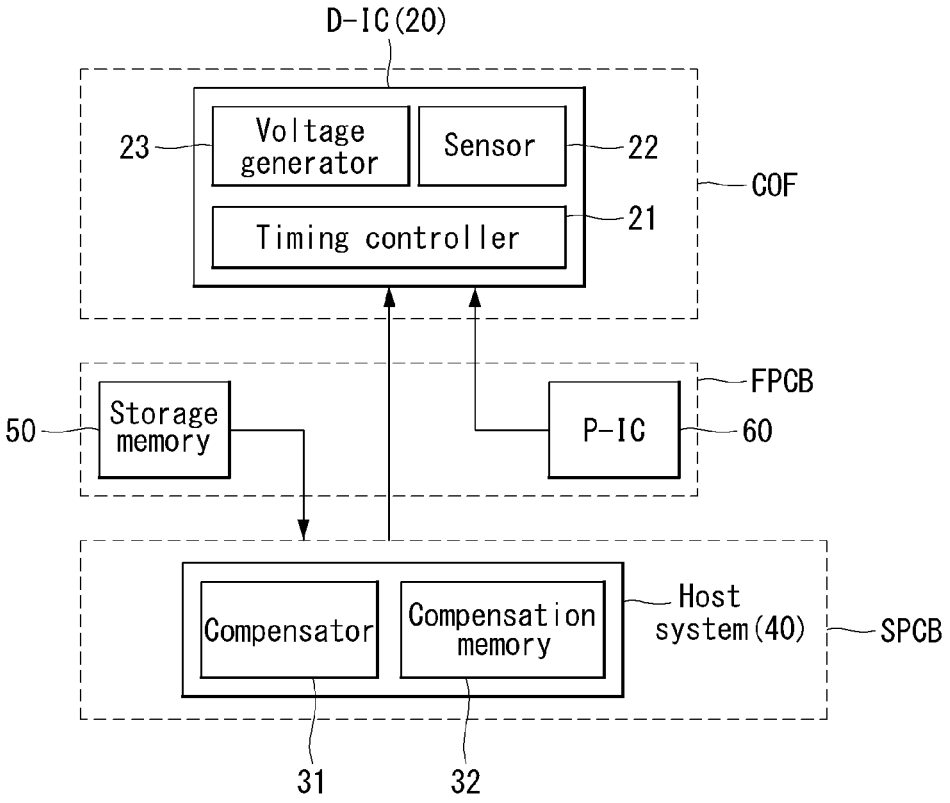
Figure 8:
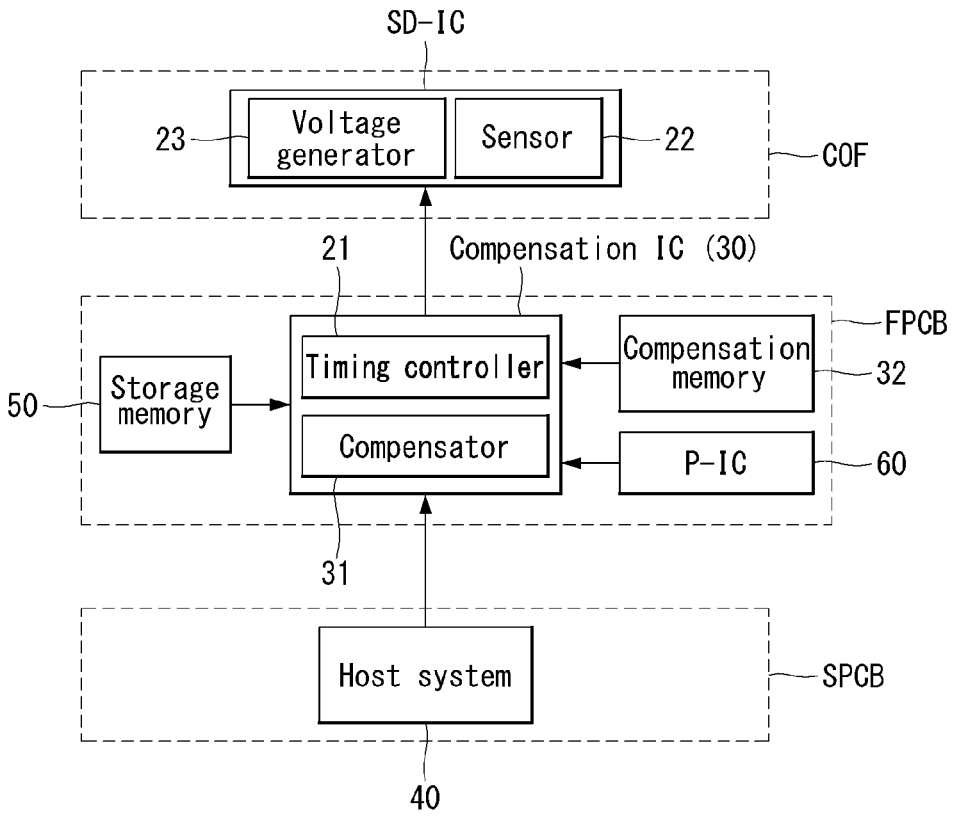

FIGS. 6 to 8 illustrate various examples of an external compensation module.

Referring to FIG. 6, the electroluminescent display according to the aspect of the disclosure may include a driver IC (or referred to as "D-IC") 20 mounted on a chip-on film (COF), a storage memory 50 and a power IC (or referred to as "P-IC") 60 mounted on a flexible printed circuit board (FPCB), and a host system 40 mounted on a system printed circuit board (SPCB), in order to implement an external compensation module.

The driver IC (D-IC) 20 may further include a compensator 31 and a compensation memory 32 in addition to a timing controller 21, a sensor 22, and a voltage generator 23. The external compensation module is implemented by forming the driver IC (D-IC) 20 and a compensation IC 30 (shown in FIG. 1) into one chip. The power IC (P-IC) 60 generates various driving powers required to operate the external compensation module.

Referring to FIG. 7, the electroluminescent display according to the aspect of the disclosure may include a driver IC (or referred to as "D-IC") 20 mounted on a chip-on film (COF), a storage memory 50 and a power IC (or referred to as "P-IC") 60 mounted on a flexible printed circuit board (FPCB), and a host system 40 mounted on a system printed circuit board (SPCB), in order to implement an external compensation module.

The external compensation module of FIG. 7 is different from the external compensation module of FIG. 6 in that a compensator 31 and a compensation memory 32 are mounted on the host system 40 without being mounted on the driver IC 20. The external compensation module of FIG. 7 is implemented by integrating a compensation IC 30 (see FIG. 1) into the host system 40 and is meaningful in that the configuration of the driver IC 20 can be simplified.

Referring to FIG. 8, the electroluminescent display according to an aspect of the disclosure may include a source driver IC SD-IC mounted on a chip-on film (COF), a storage memory 50, a compensation IC 30, a compensation memory 32, and a power IC (or referred to as "P-IC") 60 mounted on a flexible printed circuit board (FPCB), and a host system 40 mounted on a system printed circuit board (SPCB), in order to implement an external compensation module.

The external compensation module of FIG. 8 is different from the external compensation modules of FIGS. 6 and 7 in that the configuration of the source driver IC SD-IC is further simplified by mounting only a voltage generator 23 and a sensor 22 in the source driver IC SD-IC, and a timing controller 21 and the compensation memory 32 are mounted in the compensation IC 30 that is separately manufactured. The external compensation module of FIG. 8 can easily perform an uploading and downloading operation of a compensation value by together mounting the compensation IC 30, the storage memory 50, and the compensation memory 32 on the flexible printed circuit board.

Figures 9, 10:
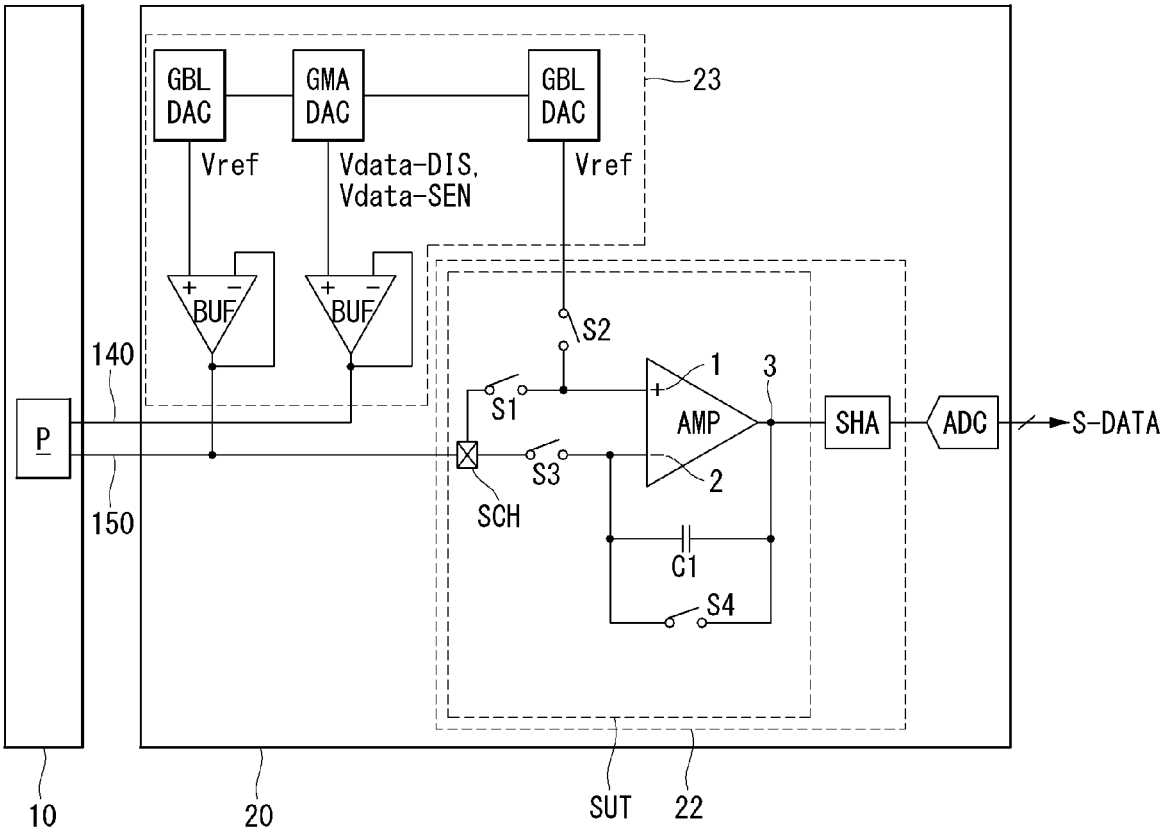
FIG. 9 illustrates a configuration of a driver IC for external compensation operating in a current sensing mode according to an aspect of the disclosure.
FIG. 10 is a table illustrating a switching timing of sensing switches included in a sensor of FIG. 9 in each operation mode.
Figure 11A:
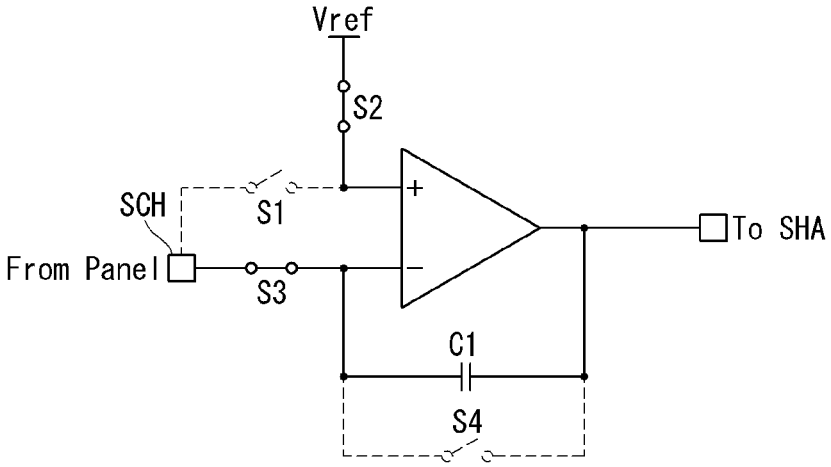
FIGS. 11A and 11B are equivalent circuit diagrams when a sensor operates in a current integrator operation mode and a first voltage follower operation mode under a current sensing mode.
Figure 11B:
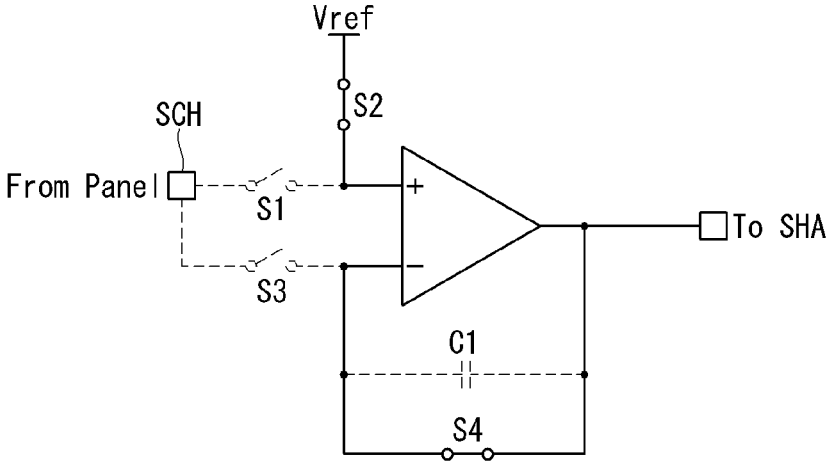

FIG. 9 illustrates a configuration of a driver IC for external compensation operating in a current sensing mode according to an aspect of the disclosure. FIG. 10 is a table illustrating a switching timing of sensing switches included in a sensor of FIG. 9 in each operation mode. FIGS. 11A and 11B are equivalent circuit diagrams when a sensor operates in a current integrator operation mode and a first voltage follower operation mode under a current sensing mode.

Referring to FIG. 9, a driver IC 20 for external compensation may include a voltage generator 23 including a GBL DAC and a GMA DAC, a sensor 22 including a sensing unit SUT and a sample and hold unit SHA, and an ADC.

The GMA DAC is connected to the data line 140 through a buffer BUF. The GMA DAC generates a display data voltage Vdata-DIS and a sensing data voltage Vdata-SEN and supplies them to the buffer BUF. The buffer BUF stabilizes the data voltages Vdata-DIS and Vdata-SEN input from the GMA DAC and then supplies them to the data line 140.

The GBL DAC is connected to the sensing line 150 and the sensing unit SUT through a buffer BUF. The reference voltage Vref generated in the GBL DAC is stabilized in the buffer BUF and then is supplied to the sensing line 150. The reference voltage Vref generated in the GBL DAC is supplied to the sensing unit SUT.

The sensing unit SUT may operate as a voltage-current sensing circuit in accordance with a switching operation of a plurality of sensing switches in a current sensing mode. In other words, the sensing unit SUT may selectively operate in a current integrator operation mode capable of sensing a current and a first voltage follower operation mode capable of sensing a voltage under the current sensing mode.

In the current integrator operation mode, the sensing unit SUT operates at a current integrator. The sensing unit SUT converts a driving current flowing in the pixel P into a voltage and supplies the voltage to the sample and hold unit SHA. The sample and hold unit SHA samples the voltage input from the sensing unit SUT and supplies the ADC with the sampled voltage as analog sensing data. The ADC converts the analog sensing data into digital sensing data and supplies the digital sensing data to a compensation IC 30. The compensation IC 30 may determine a magnitude of a driving current flowing in the pixel P through the digital sensing data without a separate calculation process.

When the sensing unit SUT is implemented as the current integrator, a sensing speed can be fast and micro-current can be sensed. More specifically, because a capacitance of a capacitor included in the current integrator are greatly less than a parasitic capacitance present in the sensing line 150, time required to accumulate the driving current up to a sensible integral level can be much less than time required to charge the sensing line 150 in a voltage sensing mode. Further, unlike a parasitic capacitor of the sensing line 150, the capacitor included in the current integrator is advantageous in that a stored value does not vary depending on a display load, and a calibration process is easy.

However, when the sensing unit SUT is implemented as the current integrator, an integral value may be distorted due to an offset value of the current integrator. Hence, when the sensing unit SUT is implemented as the current integrator, a separate calibration process for compensating for the offset value of the current integrator may be necessary.

Under the current sensing mode, the first voltage follower operation mode is proposed to easily perform the calibration process. In the first voltage follower operation mode, the sensing unit SUT may operate as a voltage buffer (or a voltage follower) and may be used to calibrate an output of the ADC. The output of the ADC may include an offset variation between the voltage generators 23, an offset variation between the sensors 22, an offset variation between the ADCs, and the like. ADC variation compensation (AVC) data generated and stored in the calibration process is used to compensate for such variations.

Under the current sensing mode, it may also be considered that the sensing unit SUT operates in the current integrator operation mode to calibrate the ADC output. However, because the current integrator is designed to be small in consideration of a chip size of the driver IC 20, a micro-current has to be supplied from the outside in accordance with the capacitance of the capacitor of the current integrator during the calibration process. It is actually difficult to uniformly receive the micro-current from the outside due to various constraints such as a noise.

On the other hand, under the current sensing mode, when the sensing unit SUT operates as the voltage buffer (or the voltage follower) so as to calibrate the ADC output, not the micro current but the reference voltage Vref is necessary. The reference voltage Vref may be received from the GBL DAC of the voltage generator 23. Further, because the reference voltage Vref is less affected by the noise than the micro-current, it is easier to calibrate the ADC output.

As shown in FIG. 9, under the current sensing mode, the sensing unit SUT capable of operating in the current integrator operation mode and the first voltage follower operation mode may include an amplifier AMP, a plurality of sensing switches S1 to S4 connected to the amplifier AMP, and a first capacitor C1.

The amplifier AMP has a non-inverting (+) input terminal 1, an inverting (−) input terminal 2, and an output terminal 3.

The first sensing switch S1 is connected between a sensing channel SCH and the non-inverting input terminal 1 of the amplifier AMP. The second sensing switch S2 is connected between the voltage generator 23 outputting the reference voltage Vref and the non-inverting input terminal 1 of the amplifier AMP. The third sensing switch S3 is connected between the sensing channel SCH and the inverting input terminal 2 of the amplifier AMP. The fourth sensing switch S4 is connected between the inverting input terminal 2 of the amplifier AMP and the output terminal 3 of the amplifier AMP.

The first capacitor C1 is a feedback capacitor connected between the inverting input terminal 2 and the output terminal 3 of the amplifier AMP.

As shown in FIGS. 10 and 11A, when the sensing unit SUT operates in the current integrator operation mode, the second and third sensing switches S2 and S3 are turned on, and the first and fourth sensing switches S1 and S4 are turned off. As a result, while a driving current flowing in the pixel P is applied to the sensing unit SUT through the sensing channel SCH and is accumulated in the first capacitor C1 of the sensing unit SUT, the driving current is converted into a voltage and then is output to the sample and hold unit SHA.

As shown in FIGS. 10 and 11B, when the sensing unit SUT operates in the first voltage follower operation mode, the second and fourth sensing switches S2 and S4 are turned on, and the first and third sensing switches S1 and S3 are turned off. As a result, the reference voltage Vref is stabilized in the sensing unit SUT and then is output to the sample and hold unit SHA.

Figures 12, 13:
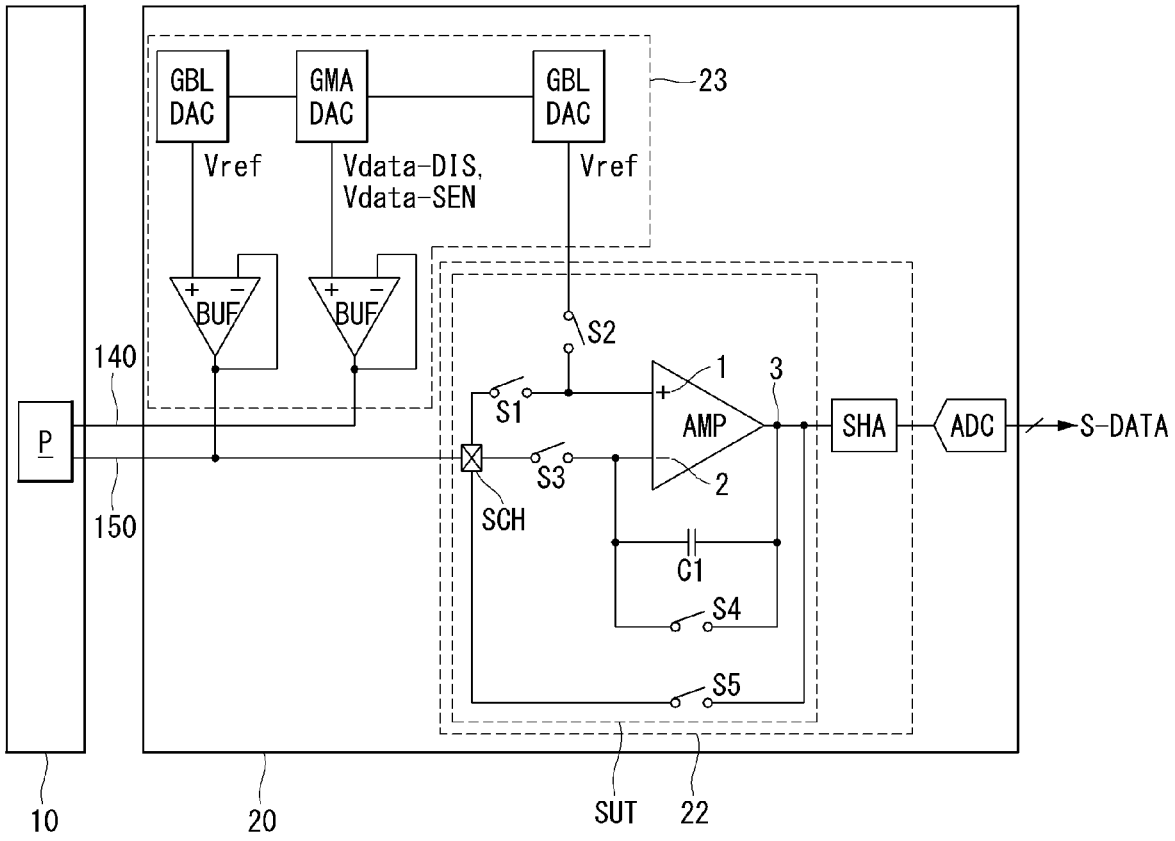
FIG. 12 illustrates a configuration of a driver IC for external compensation that can be used in both a current sensing mode and a voltage sensing mode according to an aspect of the disclosure.
FIG. 13 is a table illustrating a switching timing of sensing switches in a sensor of FIG. 12 in each operation mode.
Figure 14A:
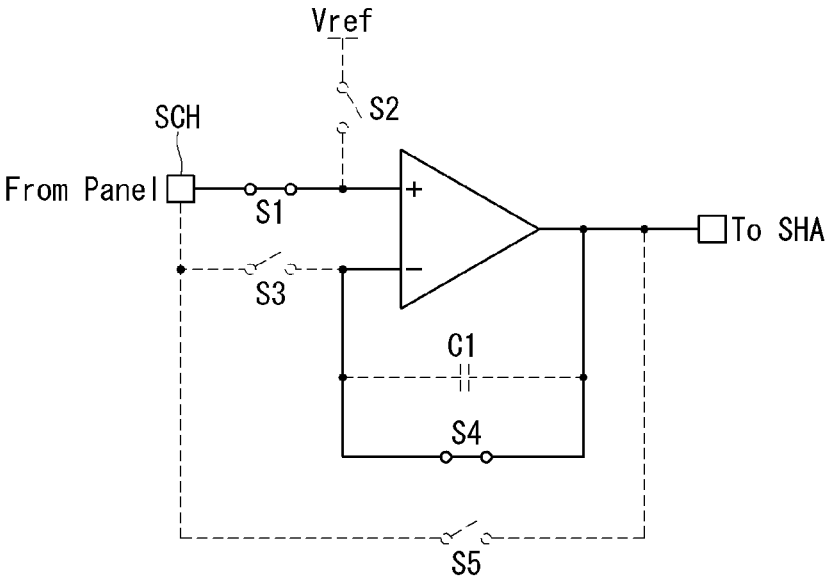
FIGS. 14A and 14B are equivalent circuit diagrams when a sensor operates in a second voltage follower operation mode and a bypass operation mode under a voltage sensing mode.
Figure 14B:
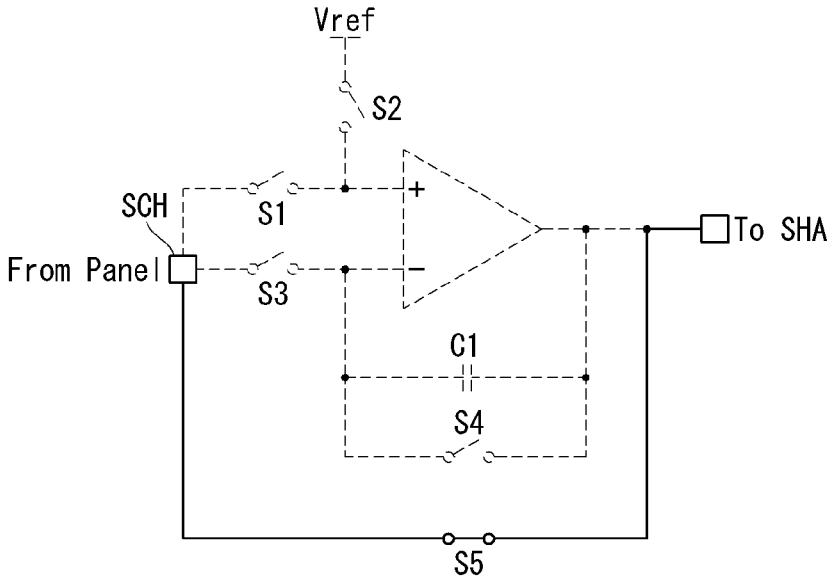

FIG. 12 illustrates a configuration of a driver IC for external compensation that can be used in both a current sensing mode and a voltage sensing mode according to an aspect of the disclosure. FIG. 13 is a table illustrating a switching timing of sensing switches included in a sensor of FIG. 12 in each operation mode. FIGS. 14A and 14B are equivalent circuit diagrams when a sensor operates in a second voltage follower operation mode and a bypass operation mode under a voltage sensing mode.

Referring to FIG. 12, a driver IC 20 for external compensation may include a voltage generator 23 including a GBL DAC and a GMA DAC, a sensor 22 including a sensing unit SUT and a sample and hold unit SHA, and an ADC.

Configuration of the voltage generator 23 is substantially the same as configuration of the voltage generator 23 illustrated in FIG. 9.

The sensing unit SUT of FIG. 12 may operate in a current sensing mode or a voltage sensing mode. A switching operation of the sensing unit SUT that operates in the current sensing mode is substantially the same as that described in FIGS. 9 to 11B.

In the voltage sensing mode, the sensing unit SUT may operate in a second voltage follower operation mode or a bypass operation mode depending on a switching operation of a plurality of sensing switches.

Under the voltage sensing mode, the second voltage follower operation mode is a mode of sensing a voltage charged to a sensing channel SCH by a driving current flowing in the driving TFT of a pixel P and obtaining ADC variation compensation (AVC) data for compensating for an output variation of the ADC. In the second voltage follower operation mode, the sensing unit SUT operates as a voltage follower. Because an input voltage is stabilized by the voltage follower and then is output in the second voltage follower operation mode, there is an advantage that a voltage charged to the sensing channel SCH can be stably sensed irrespective of an RC load of the sensing line 150.

Under the voltage sensing mode, the bypass operation mode is a mode of sensing a voltage charged to the sensing channel SCH by a driving current flowing in the driving TFT of the pixel P and obtaining AVC data for compensating for an output variation of the ADC. In the bypass operation mode, the sensing unit SUT is bypassed, and the sensing channel SCH and the sample and hold unit SHA are directly connected. The bypass operation mode has an advantage that an output variation of the sensing unit SUT is not reflected in a sensing value.

However, in the voltage sensing mode, the voltage charged to the sensing channel SCH is sampled by the sample and hold unit SHA two or more times. The reason for sampling two or more times is to find the driving current through changes in the voltage per unit time. Two or more analog sensing data are converted into digital sensing data by the ADC and then transmitted to the compensation IC 30. The compensation IC 30 applies two or more sensing data to a predetermined calculation algorithm and calculates the driving current flowing in the pixel P. The voltage sensing mode is strong to a noise, but a long sensing time is required due to two or more sensing and calculation processes.

As shown in FIG. 12, under the voltage sensing mode, the sensing unit SUT capable of operating in the second voltage follower operation mode or the bypass operation mode may include an amplifier AMP, a plurality of sensing switches S1 to S5 connected to the amplifier AMP, and a first capacitor C1.

The sensing unit SUT of FIG. 12 is different from the sensing unit SUT of FIG. 9 in that it further includes the fifth sensing switch S5. The fifth sensing switch S5 is connected between the sensing channel SCH and an output terminal 3 of the amplifier AMP.

As shown in FIGS. 13 and 14A, when the sensing unit SUT for sensing the voltage charged to the sensing channel SCH operates in the second voltage follower operation mode, the first and fourth sensing switches S1 and S4 are turned on, and the second, third, and fifth sensing switches S2, S3, and S5 are turned off. As a result, the voltage charged to the sensing channel SCH is stabilized by the sensing unit SUT operating as a voltage follower and then is output to the sample and hold unit SHA.

Although not shown, when the sensing unit SUT operates in the second voltage follower operation mode so as to obtain AVC data for compensating for an output variation of the ADC, the second and fourth sensing switches S2 and S4 may be turned on, and the first, third, and fifth sensing switches S1, S3, and S5 may be turned off.

As shown in FIGS. 13 and 14B, when the sensing unit SUT for sensing the voltage charged to the sensing channel SCH operates in the bypass operation mode, the fifth sensing switch S5 is turned on, and the first to fourth sensing switches S1 to S4 are turned off. As a result, the voltage charged to the sensing channel SCH is bypassed by the sensing unit SUT and then is output to the sample and hold unit SHA.

Figure 15:
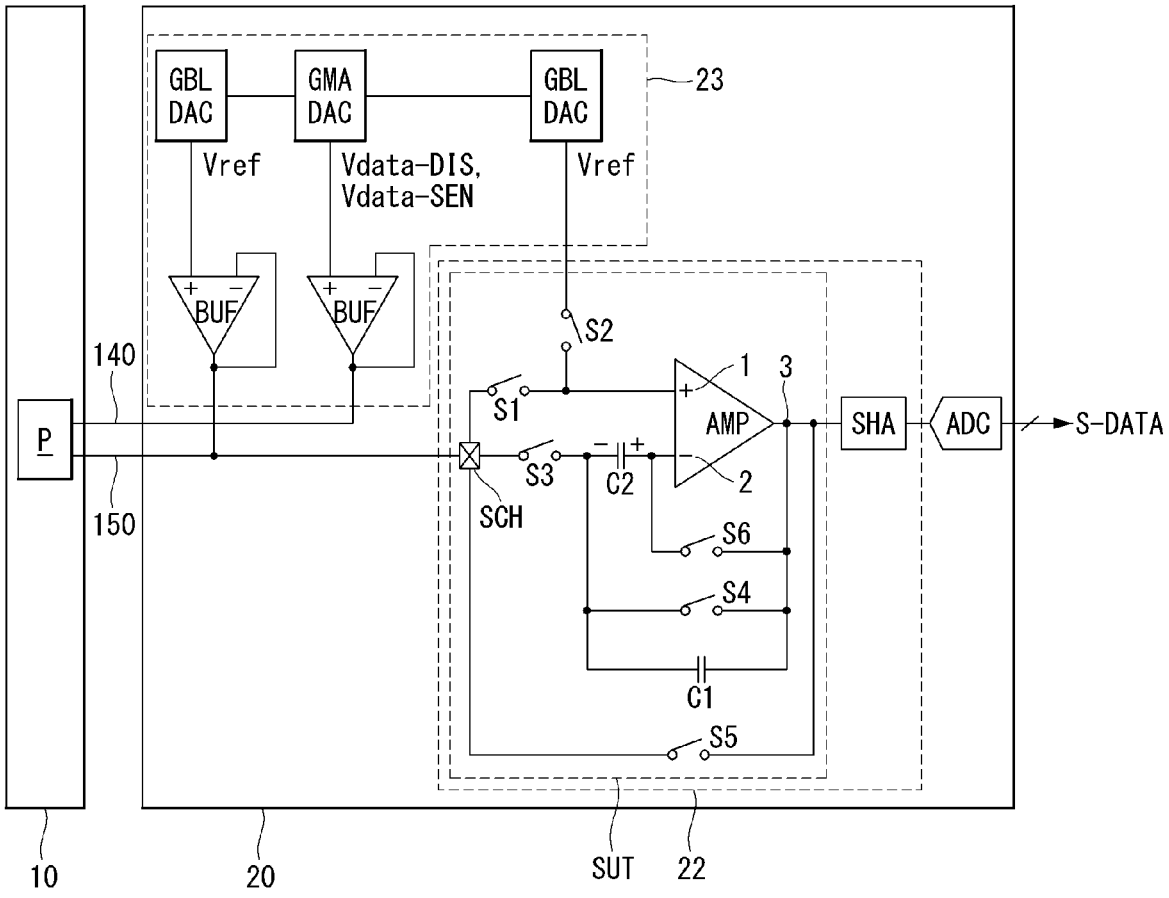
FIG. 15 illustrates a configuration of a driver IC for external compensation according to another aspect of the disclosure.
Figure 16:
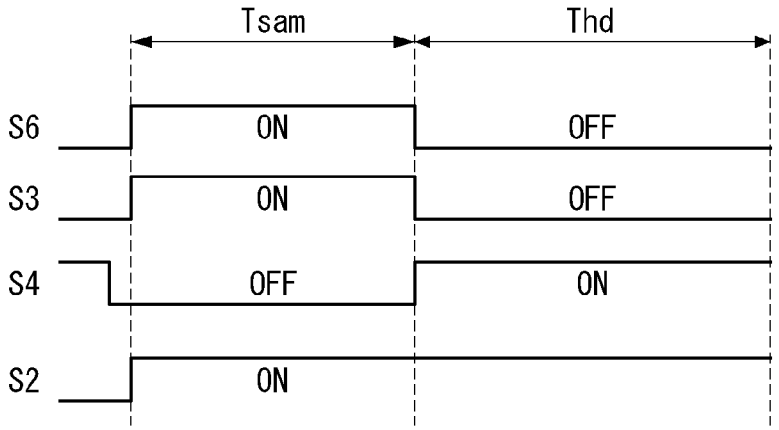
FIG. 16 illustrates a switching timing of sensing switches for performing an offset calibration in a sensor in a driver IC for external compensation of FIG. 15.
Figure 17A:
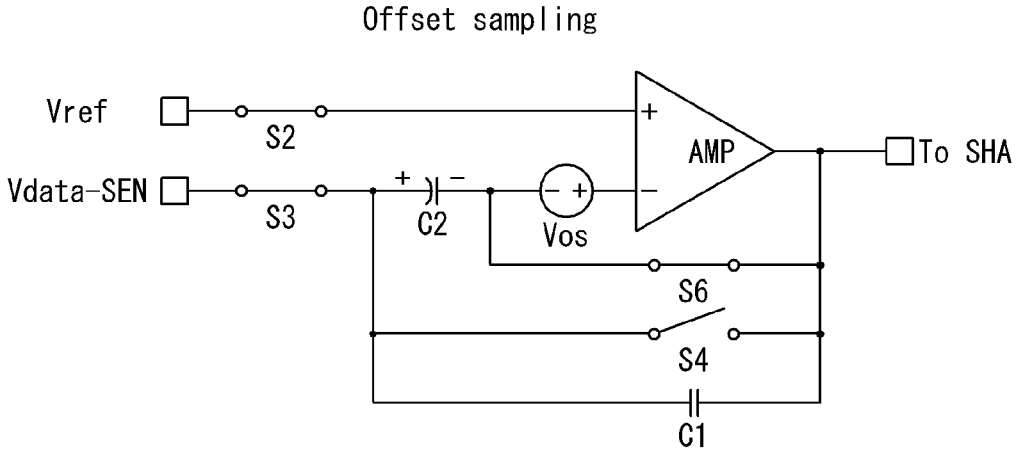
FIGS. 17A and 17B are equivalent circuit diagrams of a sensor corresponding to an offset sampling period and an offset compensation period of FIG. 16.
Figure 17B:
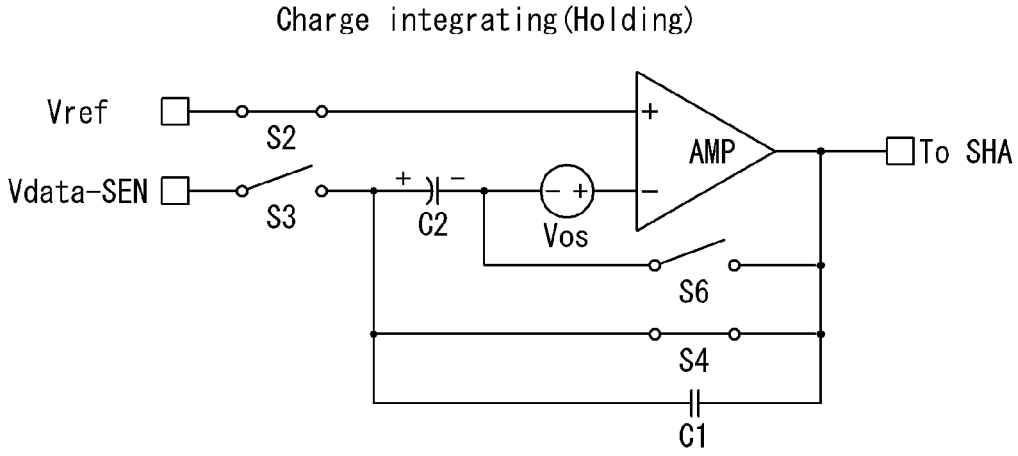

FIG. 15 illustrates a configuration of a driver IC for external compensation according to another aspect of the disclosure. FIG. 16 illustrates a switching timing of sensing switches for performing an offset calibration in a sensor included in a driver IC for external compensation of FIG. 15. FIGS. 17A and 17B are equivalent circuit diagrams of a sensor corresponding to an offset sampling period and an offset compensation period of FIG. 16.

The driver IC for external compensation of FIG. 15 is substantially the same as the driver ICs for external compensation of FIGS. 9 and 12 except for the configuration of a sensing unit SUT. Thus, a further description may be briefly made or may be omitted.

Referring to FIG. 15, a sensing unit SUT may include an amplifier AMP, a plurality of sensing switches S1 to S6 connected to the amplifier AMP, a first capacitor C1, and a second capacitor C2. The sensing unit SUT of FIG. 15 is different from the sensing units SUT of FIGS. 9 and 12, in that it further includes the sixth sensing switch S6 and the second capacitor C2 so as to calibrate an offset of the amplifier AMP by itself. When the sensing unit SUT compensates for the offset of the amplifier AMP by itself, the accuracy of the sensing can be improved accordingly.

One electrode of the second capacitor C2 is connected to an inverting (−) input terminal 2 of the amplifier AMP, and the other electrode of the second capacitor C2 is commonly connected to one end of the third sensing switch S3, one end of the fourth sensing switch S4, and one electrode of the first capacitor C1.

One end of the sixth sensing switch S6 is connected to the inverting input terminal 2 of the amplifier AMP together with one electrode of the second capacitor C2, and the other end of the sixth sensing switch S6 is connected to an output terminal 3 of the amplifier AMP.

As shown in FIG. 16, the offset of the amplifier AMP may be calibrated through an offset sampling period Tsam and an offset compensation period Thd.

As shown in FIGS. 16 and 17A, during the offset sampling period Tsam, the second, third and sixth sensing switches S2, S3 and S6 are turned on, and the fourth sensing switch S4 is turned off. As a result, one electrode of the second capacitor C2 and the output terminal 3 of the amplifier AMP are short-circuited through the sixth sensing switch S6, and a first polarity (−) offset voltage Vos of the amplifier AMP is sampled and stored in the second capacitor C2.

As shown in FIGS. 16 and 17B, during the offset compensation period Thd, the second and fourth sensing switches S2 and S4 are turned on, and the third and sixth sensing switches S3 and S6 are turned off. As a result, the other electrode of the second capacitor C2 and the output terminal 3 of the amplifier AMP are short-circuited through the fourth sensing switch S4, and a second polarity (+) offset voltage Vos of the amplifier AMP is output to the output terminal 3 of the amplifier AMP.

Thus, the first polarity (−) offset voltage Vos and the second polarity (+) offset voltage Vos are cancelled out each other at the output terminal 3 of the amplifier AMP. As a result, the offset of the amplifier AMP is compensated.

Figure 18:
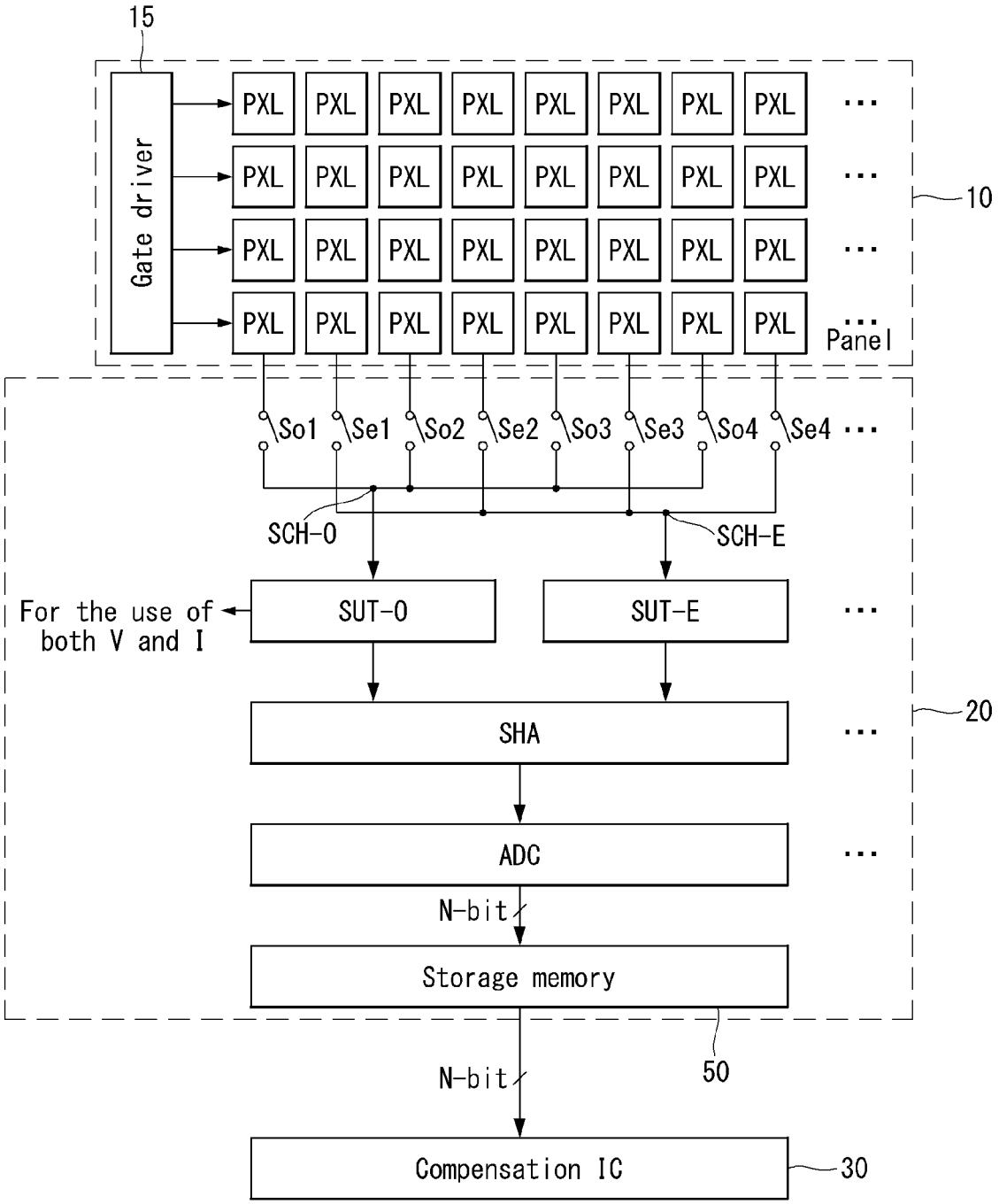
FIGS. 18 and 19 illustrate a configuration of a driver IC for external compensation capable of performing correlated double sampling in accordance with yet another aspect of the disclosure.
Figure 19:
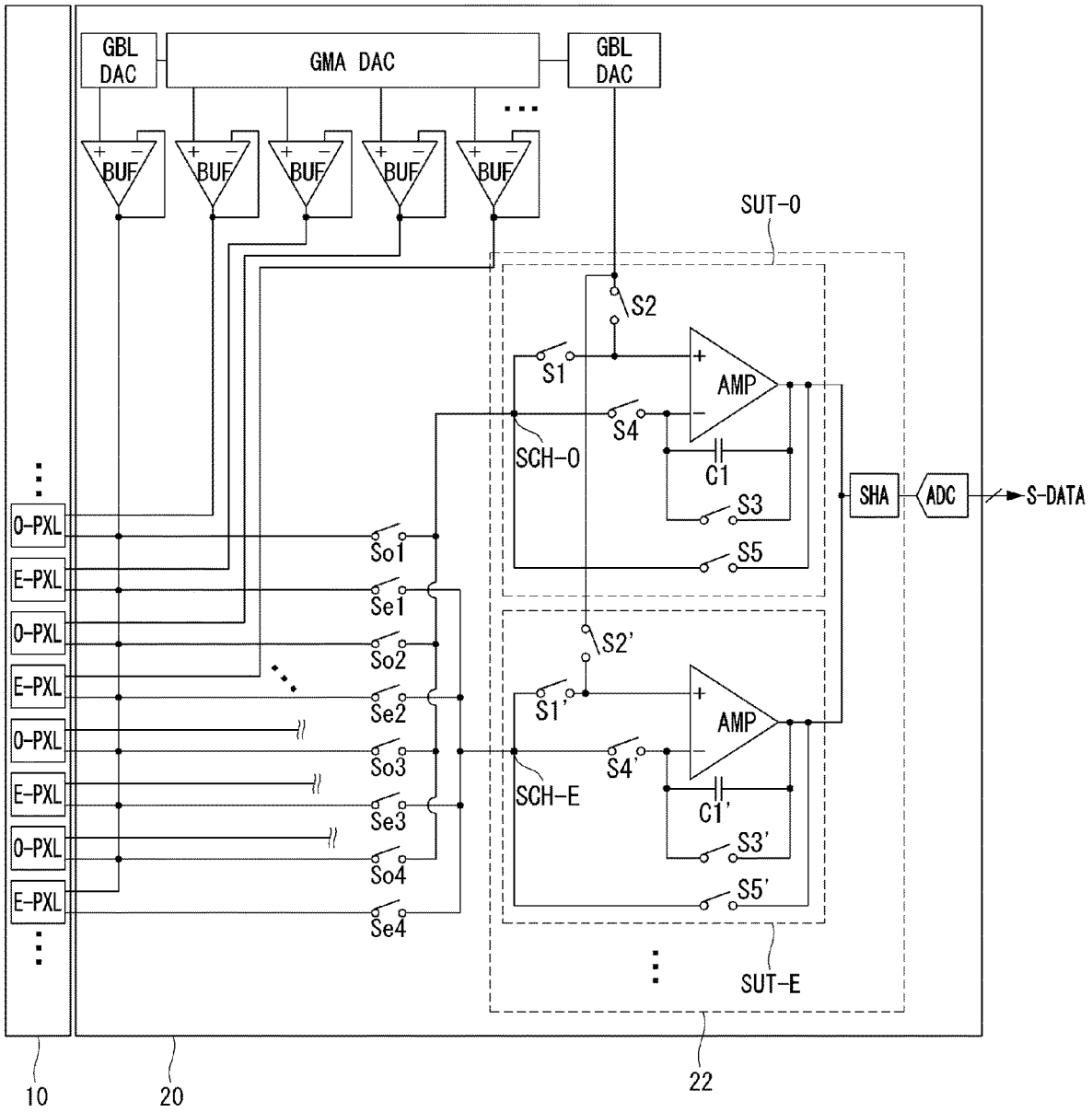
Figure 21:
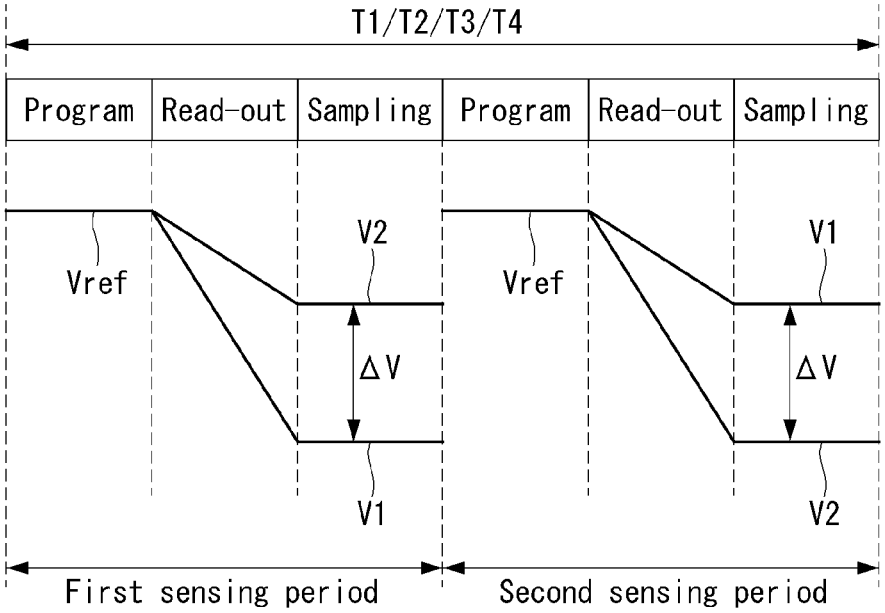
FIG. 21 illustrates an operation concept of correlated double sampling.

FIGS. 18 and 19 illustrate a configuration of a driver IC for external compensation capable of performing correlated double sampling in accordance with yet another aspect of the disclosure. FIG. 20 illustrates a switching timing of channel switches in a driver IC for external compensation shown in FIGS. 18 and 19 to perform correlated double sampling. FIG. 21 illustrates an operation concept of correlated double sampling.

Referring to FIGS. 18 and 19, a driver IC 20 for external compensation capable of performing correlated double sampling includes an odd-numbered sensing unit SUT-O, an even-numbered sensing unit SUT-E, a sample and hold unit SHA, and an ADC, and may further include a storage memory 50. The odd-numbered sensing unit SUT-O, the even-numbered sensing unit SUT-E, and the sample and hold unit SHA may constitute a sensor.

The odd-numbered sensing unit SUT-O is connected to a plurality of odd-numbered pixels O-PXL through an odd-numbered sensing channel SCH-O and senses electrical characteristics of the plurality of odd-numbered pixels O-PXL input from the odd-numbered sensing channel SCH-O.

The even-numbered sensing unit SUT-E is connected to a plurality of even-numbered pixels E-PXL through an even-numbered sensing channel SCH-E and senses electrical characteristics of the plurality of even-numbered pixels E-PXL input from the even-numbered sensing channel SCH-E.

As shown in FIG. 12, each of the odd-numbered sensing unit SUT-O and the even-numbered sensing unit SUT-E includes an amplifier AMP, a plurality of sensing switches S1 to S5 connected to the amplifier AMP, and a first capacitor C1 and may operate in a current sensing mode or a voltage sensing mode. A sensing operation in each of the current sensing mode and the voltage sensing mode is described above, and thus a description thereof is omitted.

The sample and hold unit SHA correlated-double samples a first sensing signal input from the odd-numbered sensing unit SUT-O and a second sensing signal input from the even-numbered sensing unit SUT-E and generates analog sensing data corresponding to the electrical characteristics of the odd-numbered pixels O-PXL and the even-numbered pixels E-PXL.

The ADC converts the analog sensing data sampled by the sample and hold unit SHA into digital sensing data and stores the digital sensing data in the storage memory 50.

As shown in FIGS. 18 and 19, the driver IC 20 for external compensation capable of performing the correlated double sampling further includes a plurality of odd-numbered channel switches So1, So2, So3 and So4 connected between the odd-numbered sensing channel SCH-O and the plurality of odd-numbered pixels O-PXL and a plurality of even-numbered channel switches Se1, Se2, Se3 and Se4 connected between the even-numbered sensing channel SCH-E and the plurality of even-numbered pixels E-PXL.

As shown in FIG. 20, one of the plurality of odd-numbered channel switches and one of the plurality of even-numbered channel switches, that are adjacent to each other, form a pair of channel switches. A plurality of pairs of channel switches (So1/Se1, So2/Se2, So3/Se3, and So4/Se4) is alternately turned on.

For example, a first pair of channel switches So1 and Se1 are simultaneously turned on at a first sensing time T1, a second pair of channel switches So2 and Se2 are then simultaneously turned on at a second sensing time T2, a third pair of channel switches So3 and Se3 are then simultaneously turned on at a third sensing time T3, and a fourth pair of channel switches So4 and Se4 are then simultaneously turned on at a fourth sensing time T4.

First odd-numbered channel switches and first even-numbered channel switches forming the channel switch pairs (So1/Se1, So2/Se2, So3/Se3, and So4/Se4) are commonly turned on in a first sensing period for a first correlated double sampling and a second sensing period for a second correlated double sampling. As shown in FIG. 21, each of the first to fourth sensing times T1 to T4 may include the first sensing period and the second sensing period.

In the first sensing period, a GMA DAC included in a voltage generator applies a sensing data voltage of a first level to the odd-numbered pixel O-PXL connected to the first odd-numbered channel switch and applies a sensing data voltage of a second level to the even-numbered pixel E-PXL connected to the first even-numbered channel switch.

In the second sensing period, the GMA DAC applies the sensing data voltage of the second level to the odd-numbered pixel O-PXL connected to the first odd-numbered channel switch and applies the sensing data voltage of the first level to the even-numbered pixel E-PXL connected to the first even-numbered channel switch.

In aspects disclosed herein, the sensing data voltage of the first level indicates a voltage for activating the odd-numbered pixel O-PXL and the even-numbered pixel E-PXL so that a driving current can flow in each of the odd-numbered pixel O-PXL and the even-numbered pixel E-PXL. Further, the sensing data voltage of the second level indicates a voltage for inactivating the odd-numbered pixel O-PXL and the even-numbered pixel E-PXL so that the driving current does not flow in each of the odd-numbered pixel O-PXL and the even-numbered pixel E-PXL. For example, the sensing data voltage of the first level may be greater than a sum of a threshold voltage Vth of a driving TFT included in each pixel and a reference voltage Vref and may be a data voltage of a gray level capable of turning on the driving TFT. Further, the sensing data voltage of the second level may be less than a sum of the threshold voltage Vth of the driving TFT included in each pixel and the reference voltage Vref and may be a data voltage of a gray level capable of turning off the driving TFT.

Thus, as shown in FIG. 21, during the first sensing period, a first sensing signal V1 input from the odd-numbered sensing unit SUT-O includes an electrical characteristic value of the activated odd-numbered pixel O-PXL and a common noise component, and a second sensing signal V2 input from the even-numbered sensing unit SUT-E includes a common noise component of the inactivated even-numbered pixel E-PXL. During the first sensing period, the second sensing signal V2 is greater than the first sensing signal V1 by ΔV. In aspects disclosed herein, the common noise component indicates a noise commonly present in the sensing line 150. Each of the odd-numbered sensing unit SUT-O and the even-numbered sensing unit SUT-E may operate as a current integrator as shown in FIG. 11A. Because an inverting (−) input terminal 2 of the current integrator of FIG. 11A is connected to the sensing channel SCH, an output of the current integrator has a value less than the reference voltage Vref of an initialization state. An output value (i.e., a magnitude of the sensing signal) of the current integrator is inversely proportional to a level of a signal input from the sensing channel SCH. In other words, as the level of the signal input from the sensing channel SCH increases, the magnitude of the sensing signal gradually decreases. Further, during the second sensing period, a first sensing signal V1 input from the odd-numbered sensing unit SUT-O includes a common noise component of the inactivated odd-numbered pixel O-PXL, and a second sensing signal V2 input from the even-numbered sensing unit SUT-E includes an electrical characteristic value of the activated even-numbered pixel E-PXL and a common noise component. During the second sensing period, the first sensing signal V1 is greater than the second sensing signal V2 by AV.

As shown in FIG. 21, during the first sensing period, the sample and hold unit SHA generates a result V2−V1 obtained by subtracting a magnitude of the first sensing signal V1 from a magnitude of the second sensing signal V2 as analog sensing data corresponding to the electrical characteristics of the odd-numbered pixel O-PXL. Because the analog sensing data corresponding to the electrical characteristics of the odd-numbered pixel O-PXL does not include the common noise component, a distortion of sensing data is minimized or prevented, and the accuracy of the sensing increases. Further, during the second sensing period, the sample and hold unit SHA generates a result V1−V2 obtained by subtracting a magnitude of the second sensing signal V2 from a magnitude of the first sensing signal V1 as analog sensing data corresponding to the electrical characteristics of the even-numbered pixel E-PXL. Because the analog sensing data corresponding to the electrical characteristics of the even-numbered pixel E-PXL does not include the common noise component, a distortion of sensing data is minimized or prevented, and the accuracy of the sensing increases.

As described above, aspects of the disclosure can minimize or prevent a distortion of sensing data by improving a sensing performance of electrical characteristics of pixels.

Aspects of the disclosure can perform both the voltage sensing and the current sensing and can significantly improve the accuracy of the compensation by performing a compensation calculation using advantages of each of the voltage sensing and the current sensing.

Aspects of the disclosure can perform the accurate sensing using a voltage buffer regardless of an RC load of sensing lines in the voltage sensing mode, and can greatly reduce a sensing time using a current integrator in the current sensing mode.

Aspects of the disclosure can easily perform a calibration process by operating the sensor as the voltage buffer when the calibration process is performed on the sensor capable of operating as the current integrator. Because an offset of an amplifier generated in the sensor is reflected in the ADC output through the voltage buffer, an output variation of the DAC, an offset variation of the amplifier, and an output variation of the ADC, and the like can be efficiently compensated.

Aspects of the disclosure can prevent the common noise component present in the sensing lines from being inserted into the sensing data by applying a correlated double sampling method and can increase the accuracy and the reliability of the sensing.

It will be apparent to those skilled in the art that various modifications and variations may be made in the present disclosure without departing from the spirit or scope of the disclosure. Thus, it is intended that aspects of the present disclosure cover the modifications and variations of this disclosure provided they come within the scope of the appended claims and their equivalents.

What is claimed is:

1. A driver integrated circuit for external compensation that minimizes a distortion of sensing data by increasing a sensing performance, comprising:

a sensing circuit including a plurality of sensing switches, connected to a plurality of pixels through a sensing channel, and operating differently depending on a current sensing mode and a voltage sensing mode, the sensing circuit sensing electrical characteristics of the plurality of pixels input from the sensing channel;

a sample and hold unit sampling analog sensing data corresponding to the electrical characteristics of the plurality of pixels; and an analog-to-digital converter (ADC) converting the sampled analog sensing data into digital sensing data; and a voltage generator generating a data voltage and a reference voltage, wherein a driving current from the plurality of pixels is supplied to the sensing circuit operating as a current integrator during the current sensing mode, and the reference voltage is directly supplied to the sensing circuit operating as a voltage buffer and used to calibrate an output of the analog-to-digital converter during the current sensing mode.

2. The driver integrated circuit for external compensation of claim 1, wherein the current sensing mode is a mode of directly sensing a driving current flowing in a driving thin film transistor (TFT) of the pixel, and the voltage sensing mode is a mode of sensing a voltage charged to the sensing channel by the driving current flowing in the driving TFT of the pixel.

3. The driver integrated circuit for external compensation of claim 1, wherein the current sensing mode includes a current integrator operation mode that allows the sensing circuit to operate as a current integrator, in order to directly sense a driving current flowing in a driving thin film transistor (TFT) of the plurality of pixels.

4. The driver integrated circuit for external compensation of claim 3, wherein the current sensing mode further includes a first voltage follower operation mode that allows the sensing circuit to operate as a voltage follower, in order to obtain ADC variation compensation (AVC) data for compensating for an output variation of the analog-to-digital converter.

5. The driver integrated circuit for external compensation of claim 4, wherein the sensing circuit comprises:

an amplifier having a non-inverting input terminal, an inverting input terminal, and an output terminal;

a first sensing switch connected between the sensing channel and the non-inverting input terminal of the amplifier;

a second sensing switch connected between a voltage generator outputting a reference voltage and the non-inverting input terminal of the amplifier;

a third sensing switch connected between the sensing channel and the inverting input terminal of the amplifier;

a fourth sensing switch connected between the inverting input terminal of the amplifier and the output terminal of the amplifier; and a first capacitor connected between the inverting input terminal of the amplifier and the output terminal of the amplifier.

6. The driver integrated circuit for external compensation of claim 5, wherein the second and third sensing switches are turned on and the first and fourth sensing switches are turned off in the current integrator operation mode.

7. The driver integrated circuit for external compensation of claim 5, wherein the second and fourth sensing switches are turned on and the first and third sensing switches are turned off in the first voltage follower operation mode.

8. The driver integrated circuit for external compensation of claim 5, wherein the voltage sensing mode includes a second voltage follower operation mode that allows the sensing circuit to operate as a voltage follower or a bypass operation mode of bypassing the sensing circuit and directly connecting the sensing channel to the sample and hold unit, in order to sense a voltage charged to the sensing channel by the driving current flowing in the driving TFT of the plurality of pixels.

9. The driver integrated circuit for external compensation of claim 8, wherein the sensing circuit further includes a fifth sensing switch connected between the sensing channel and the output terminal of the amplifier.

10. The driver integrated circuit for external compensation of claim 9, wherein the first and fourth sensing switches are turned on and the second, third, and fifth sensing switches are turned off in the second voltage follower operation mode.

11. The driver integrated circuit for external compensation of claim 9, wherein the fifth sensing switch is turned on and the first to fourth sensing switches are turned off in the bypass operation mode.

12. The driver integrated circuit for external compensation of claim 5, wherein the sensing circuit further includes a second capacitor and a sixth sensing switch in order to calibrate an offset of the amplifier, wherein one electrode of the second capacitor is connected to the inverting input terminal of the amplifier, and the other electrode of the second capacitor is commonly connected to one end of the third sensing switch, one end of the fourth sensing switch, and one electrode of the first capacitor, and wherein one end of the sixth sensing switch is commonly connected to the inverting input terminal of the amplifier and the one electrode of the second capacitor, and the other end of the sixth sensing switch is connected to the output terminal of the amplifier.

13. The driver integrated circuit for external compensation of claim 12, wherein the offset of the amplifier is calibrated during an offset sampling period and an offset compensation period, wherein the second, third and sixth sensing switches are turned on and the fourth sensing switch is turned off during the offset sampling period, and wherein the second and fourth sensing switches are turned on and the third and sixth sensing switches are turned off during the offset compensation period.

14. A driver integrated circuit for external compensation that minimizes a distortion of sensing data by increasing a sensing performance, comprising:

an odd-numbered sensing circuit connected to a plurality of odd-numbered pixels through an odd-numbered sensing channel and sensing electrical characteristics of the plurality of odd-numbered pixels input from the odd-numbered sensing channel;

an even-numbered sensing circuit connected to a plurality of even-numbered pixels through an even-numbered sensing channel and sensing electrical characteristics of the plurality of even-numbered pixels input from the even-numbered sensing channel;

a sample and hold unit configured to correlated-double sample a first sensing signal input from the odd-numbered sensing circuit and a second sensing signal input from the even-numbered sensing circuit and generate analog sensing data corresponding to the electrical characteristics of the odd-numbered pixels and the even-numbered pixels; and an analog-to-digital converter (ADC) converting the sampled analog sensing data into digital sensing data; and a voltage generator generating a data voltage and a reference voltage, wherein a driving current from the plurality of pixels is supplied to the sensing circuit operating as a current integrator during the current sensing mode, and the reference voltage is directly supplied to the sensing circuit operating as a voltage buffer and used to calibrate an output of the analog-to-digital converter during the current sensing mode, and wherein the odd-numbered sensing circuit and the even-numbered sensing circuit each includes a plurality of sensing switches operating differently depending on a current sensing mode and a voltage sensing mode.

15. The driver integrated circuit for external compensation of claim 14, further comprising:

a plurality of odd-numbered channel switches connected between the odd-numbered sensing channel and the plurality of odd-numbered pixels; and a plurality of even-numbered channel switches connected between the even-numbered sensing channel and the plurality of even-numbered pixels.

16. The driver integrated circuit for external compensation of claim 15, wherein a pair of channel switches is formed by one of the plurality of odd-numbered channel switches and one of the plurality of even-numbered channel switches, which are adjacent to each other, and a plurality of pairs of channel switches are formed by the pair of channel switched, wherein the plurality of pairs of channel switches is alternately turned on.

17. The driver integrated circuit for external compensation of claim 16, wherein a first odd-numbered channel switch and a first even-numbered channel switch forming a first pair of channel switch are commonly turned on during a first sensing period for a first correlated double sampling and a second sensing period for a second correlated double sampling.

18. The driver integrated circuit for external compensation of claim 17, wherein the first sensing period and the second sensing period are successively arranged.

19. The driver integrated circuit for external compensation of claim 17, further comprising a voltage generator configured to:

apply a sensing data voltage of a first level to the odd-numbered pixel connected to the first odd-numbered channel switch and apply a sensing data voltage of a second level to the even-numbered pixel connected to the first even-numbered channel switch during the first sensing period; and apply the sensing data voltage of the second level to the odd-numbered pixel connected to the first odd-numbered channel switch and apply the sensing data voltage of the first level to the even-numbered pixel connected to the first even-numbered channel switch during the second sensing period, wherein the sensing data voltage of the first level activates the odd-numbered pixel and the even-numbered pixel so that a driving current can flow in each of the odd-numbered pixel and the even-numbered pixel, and wherein the sensing data voltage of the second level inactivates the odd-numbered pixel and the even-numbered pixel so that the driving current does not flow in each of the odd-numbered pixel and the even-numbered pixel.

20. The driver integrated circuit for external compensation of claim 19, wherein during the first sensing period, a first sensing signal input from the odd-numbered sensing circuit includes an electrical characteristic value of the odd-numbered pixel and a common noise component, and a second sensing signal input from the even-numbered sensing circuit includes the common noise component, and wherein during the second sensing period, the first sensing signal input from the odd-numbered sensing circuit includes the common noise component, and the second sensing signal input from the even-numbered sensing circuit includes an electrical characteristic value of the even-numbered pixel and the common noise component.

21. The driver integrated circuit for external compensation of claim 20, wherein the sample and hold unit generates a result obtained by subtracting a magnitude of the first sensing signal from a magnitude of the second sensing signal as analog sensing data corresponding to the electrical characteristics of the odd-numbered pixel during the first sensing period, and wherein the sample and hold unit generates a result obtained by subtracting a magnitude of the second sensing signal from a magnitude of the first sensing signal as analog sensing data corresponding to the electrical characteristics of the even-numbered pixel during the second sensing period.

22. A display device that minimizes a distortion of sensing data by increasing a sensing performance, comprising:

a display panel including a plurality of pixels; and a driver integrated circuit for external compensation configured to generate a voltage driving the plurality of pixels and sense electrical characteristics of the plurality of pixels in a predetermined period of time, wherein the driver integrated circuit for external compensation includes:

a sensing circuit including a plurality of sensing switches, connected to the plurality of pixels through a sensing channel and operating differently depending on a current sensing mode and a voltage sensing mode, the sensing circuit sensing the electrical characteristics of the plurality of pixels input from the sensing channel;

a sample and hold unit sampling analog sensing data corresponding to the electrical characteristics of the plurality of pixels; and an analog-to-digital converter converting the sampled analog sensing data into digital sensing data; and a voltage generator generating a data voltage and a reference voltage, wherein a driving current from the plurality of pixels is supplied to the sensing circuit operating as a current integrator during the current sensing mode, and the reference voltage is directly supplied to the sensing circuit operating as a voltage buffer and used to calibrate an output of the analog-to-digital converter during the current sensing mode.

* * * * *